US005732310A

United States Patent [19]

Hiroshima et al.

[11] Patent Number: 5,732,310

[45] Date of Patent: Mar. 24, 1998

[54] IMAGE FORMING APPARATUS HAVING CLEANING DEVICE FOR CLEANING INTERMEDIATE TRANSFER MEMBER

[75] Inventors: Koichi Hiroshima, Kawasaki; Katsuhiko Nishimura, Yokohama; Shinichi Tsukida, Yono; Toru Kosaka, Machida; Yasuo Yoda, Kawasaki, all of Japan

[73] Assignee: Canon Kabushiki Kaisha, Tokyo, Japan

[21] Appl. No.: 633,470

[22] Filed: Apr. 17, 1996

[30] Foreign Application Priority Data

Apr. 21, 1995 [JP] Japan ..... 7-096964
May 23, 1995 [JP] Japan ..... 7-123905

[51] Int. Cl.[6] ..... G03G 15/16

[52] U.S. Cl. ..... 399/101

[58] Field of Search ..... 399/100, 101, 399/302, 308; 355/271, 274, 326 R, 327

[56] References Cited

U.S. PATENT DOCUMENTS

| | | | |
|---|---|---|---|
| 4,461,563 | 7/1984 | Favata . | |
| 5,079,597 | 1/1992 | Mauer et al. | 355/303 |
| 5,132,738 | 7/1992 | Nakamura et al. | 355/274 |
| 5,173,735 | 12/1992 | Kusumoto | 355/271 |
| 5,179,397 | 1/1993 | Ohzeki et al. | 355/271 X |
| 5,198,863 | 3/1993 | Goto et al. | 355/274 |
| 5,264,902 | 11/1993 | Suwa et al. | 355/282 |
| 5,285,245 | 2/1994 | Goto et al. | 355/271 |
| 5,337,127 | 8/1994 | Imaue | 355/271 |
| 5,485,256 | 1/1996 | Randell et al. | 355/271 |

FOREIGN PATENT DOCUMENTS

| | | |
|---|---|---|
| 54-063838 | 5/1979 | Japan . |
| 56-153357 | 11/1981 | Japan . |
| 1-105980 | 4/1989 | Japan . |
| 4-296785 | 10/1992 | Japan . |
| 4-340564 | 11/1992 | Japan . |
| 5-297739 | 11/1993 | Japan . |
| 5-303310 | 11/1993 | Japan . |

*Primary Examiner*—Robert Beatty
*Attorney, Agent, or Firm*—Fitzpatrick, Cella, Harper & Scinto

[57] ABSTRACT

In an image forming apparatus a toner image is transferred onto a transfer material using an intermediate transfer member. The image forming apparatus has an image bearing member; a toner image forming unit for forming a toner image on the image bearing member; an intermediate transfer member movable along an endless path in contact with the image bearing member; a bias voltage applicator for applying a bias voltage to transfer the toner image from the image bearing member onto the intermediate transfer member at a first transfer position of the intermediate transfer member; and an image transfer device for transferring the toner image from the intermediate transfer member onto the transfer material at a second transfer position of the intermediate transfer member, a residual toner charge for charging residual toner remaining on the intermediate transfer member after image transfer therefrom, to a polarity opposite from a regular polarity of the toner to permit the residual toner to transfer back, simultaneously with a next image transfer at the first transfer position, to the image bearing member when the residual toner passes through the first transfer position.

29 Claims, 17 Drawing Sheets

$$SF1 = \frac{(MXLNG)^2}{AREA} \times \frac{\pi}{4} \times 100$$

$$SF2 = \frac{(PERI)^2}{AREA} \times \frac{\pi}{4} \times 100$$

| TONER / BIAS | MONO | | 4-COLOR SUPERIMPOSE | |
|---|---|---|---|---|
| | CLEANING | NEGATIVE GHOST | CLEANING | NEGATIVE GHOST |
| 0 | N | G | N | G |
| 5μA | F | G | N | G |
| 10μA | G | G | F | G |
| 20μA | G | G | G | G |
| 30μA | G | G | G | G |
| 40μA | G | F | G | G |
| 50μA | G | N | G | F |

G : GOOD

F : FAIR

N : NO GOOD

FIG. 9

| TONER / BIAS | MONO | | 4-COLOR SUPERIMPOSE | |
|---|---|---|---|---|
| | CLEANING | NEGATIVE GHOST | CLEANING | NEGATIVE GHOST |
| 0 | N | G | N | G |
| 50V | N | G | N | G |
| 100V | N | G | N | G |
| 200V | F | G | F | G |
| 300V | G | G | G | G |
| 400V | G | G | G | G |
| 500V | G | G | G | G |

G : GOOD

F : FAIR

N : NO GOOD

FIG. 12

| TONER / BIAS | MONO | | 4-COLOR SUPERIMPOSE | |
|---|---|---|---|---|
| | CLEANING | NEGATIVE GHOST | CLEANING | NEGATIVE GHOST |
| 0 | N | G | N | G |
| 5μA | G | G | F | G |
| 10μA | G | G | G | G |
| 20μA | G | G | G | G |
| 30μA | G | F | G | F |
| 40μA | G | N | G | N |
| 50μA | G | N | G | N |

G : GOOD

F : FAIR

N : NO GOOD

FIG. 15

IMAGE FORMING APPARATUS HAVING CLEANING DEVICE FOR CLEANING INTERMEDIATE TRANSFER MEMBER

FIELD OF THE INVENTION AND RELATED ART

The present invention relates to an image forming apparatus such as a printer or a copying machine, which outputs a recorded image through a process of transferring a toner image onto a transfer medium.

Color image forming apparatus of this type have been known that produce a color image through a primary transfer stage in which two or more different color images formed on a photosensitive member such as an image bearing member are sequentially transferred onto an intermediate transfer member, and a secondary transfer stage in which a color image (or multi-color image) resulting from these two or more toner images of a different color are transferred all at once onto a transfer medium.

However, in the image forming apparatus employing the above described intermediate transfer member, a certain amount of untransferred toner remains on the intermediate transfer member after the secondary transfer, that is, after the image is transferred from the intermediate transfer member to the transfer medium such as a sheet of paper. The removal and disposal of this untransferred toner presents a technical problem.

There are several means for solving the above problem. For example, Japanese Laid-Open Patent Application Nos. 153,357/1981 and 303,310/1993 disclose a type of such means, according to which the toner on the intermediate transfer member is scraped away by an elastic blade, which is placed in contact with, or moved away from, the intermediate transfer member.

According to another type, a fur brush which is placed in contact with, or moved away from, the intermediate transfer member is provided, and the toner remaining on the intermediate transfer member after the secondary transfer is recovered by applying to this fur brush a bias with a polarity opposite to that of the residual toner. Next, the residual toner is adhered to a bias roller such as a metallic roller, and then is scraped away by a blade.

Further, according to the means proposed in Japanese Laid-Open Patent Application Nos, 340,564/1992, and 105, 980/1989 the residual toner on the intermediate transfer member is returned to the photosensitive drum with the use of an electric field, while no transfer process is carried out, and then, the returned residual toner is recovered by the cleaner of the photosensitive drum.

In any of the above proposals, the toner returned to the photosensitive drum has the same polarity as the polarity of the toner image formed on the photosensitive drum.

However, the above described cleaning method for the intermediate transfer member has the following weaknesses. That is, in the case of a cleaning apparatus such as a cleaning blade which mechanically scrapes the toner on the intermediate transfer member, when the blade is moved away from the intermediate transfer member, a portion of the toner having accumulated on the blade portion is left on the intermediate transfer member, causing a trace of the blade to appear as a part of the image during the following printing process. Further, the blade, and the intermediate transfer member with which the blade is placed in contact, wear out, or deteriorate, through usage, and as they wear out or deteriorate, the toner is allowed to escape the cleaning blade, or the transfer efficiency is reduced by the surface layer deterioration of the intermediate transfer member.

The cleaning apparatus which employs a fur brush to recover the residual toner on the intermediate transfer member also has a fault, that is, being costly due to its large size and complexity.

In the case of the means for returning the residual toner having the same polarity as that of the toner image formed on the photosensitive member from the intermediate transfer member to the photosensitive member, an additional process is necessary, which transfers the residual toner from the intermediate transfer member back to the photosensitive member while a normal transfer process is not in progress. Therefore, so-called throughput, that is, the number of recording mediums which can be outputted per unit time, is reduced.

SUMMARY OF THE INVENTION

Accordingly, it is a principal object of the present invention to provide an apparatus and method wherein residual toner can be effectively removed from an intermediate transfer material.

According to an aspect of the present invention, there is provided an image forming apparatus, wherein a toner image is transferred onto a transfer material using an intermediate transfer member, the image forming apparatus comprising: an image bearing member; toner image forming means for forming a toner image on an image bearing member; an intermediate transfer member movable along an endless path in contact with the image bearing member; bias voltage application means for applying a bias voltage for transferring the toner image from the image bearing member onto the intermediate transfer member at a first transfer position of the intermediate transfer member; image transfer means for transferring the toner image from the intermediate transfer member onto the transfer material at a second transfer position of the intermediate transfer member; residual toner charging means for charging residual toner remaining on the intermediate transfer member after image transfer therefrom, to a polarity opposite from a regular polarity of the toner to permit the residual toner to transfer back, simultaneously with a next image transfer at the first transfer position, to the image bearing member when the residual toner passes through the first transfer position.

According to another aspect of the present invention, there is provided an image forming apparatus, wherein a toner image is transferred onto a transfer material using an intermediate transfer member, the image forming apparatus comprising: an image bearing member; toner image forming means for forming a multi-color toner image on an image bearing member; an intermediate transfer member movable along an endless path in contact with the image bearing member; bias voltage application means for applying a bias voltage for transferring the toner image from the image bearing member onto the intermediate transfer member at a first transfer position of the intermediate transfer member, for each color; image transfer means for transferring the color toner images all at once from the intermediate transfer member onto the transfer material at a second transfer position of the intermediate transfer member; residual toner charging means for charging, after image transfer at the second transfer position, residual toner remaining on the intermediate transfer member after image transfer therefrom, to a polarity opposite from a regular polarity of the toner to permit the residual toner to transfer back, simultaneously with a next image transfer at the first transfer position, to the image bearing member when the residual toner passes through the first transfer position.

According to a further aspect of the present invention, there is provided an image forming apparatus, wherein a toner image is transferred onto a transfer material using an intermediate transfer member, the image forming apparatus comprising: an image bearing member which is an electro-photographic photosensitive member; developing means for forming a toner image on an image bearing member, using black toner and chromatic toner; an intermediate transfer member movable along an endless path in contact with the image bearing member; bias voltage application means for applying a bias voltage for transferring the toner image from the image bearing member onto the intermediate transfer member at a first transfer position of the intermediate transfer member; image transfer means for transferring the toner image from the intermediate transfer member onto the transfer material at a second transfer position of the intermediate transfer member; wherein the apparatus is operable in a single color mode and in a multi-color mode; residual toner charging means for charging, after image transfer at the second transfer position, residual toner remaining on the intermediate transfer member after image transfer therefrom, to a polarity opposite from a regular polarity of the toner to permit the residual toner to transfer back, simultaneously with a next image transfer at the first transfer position, to the image bearing member when the residual toner passes through the first transfer position.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 9 is a table showing the cleaning characteristics of the intermediate transfer member cleaning elastic charge roller.

FIG. 12 is a table showing the cleaning characteristics of the intermediate transfer member cleaning means employing a fur brush as a means for applying a cleaning voltage.

FIG. 15 is a table showing the cleaning characteristics of the intermediate transfer member cleaning means employing the corona type charger.

DESCRIPTION OF THE PREFERRED EMBODIMENTS

Embodiment 1

Figure 1:
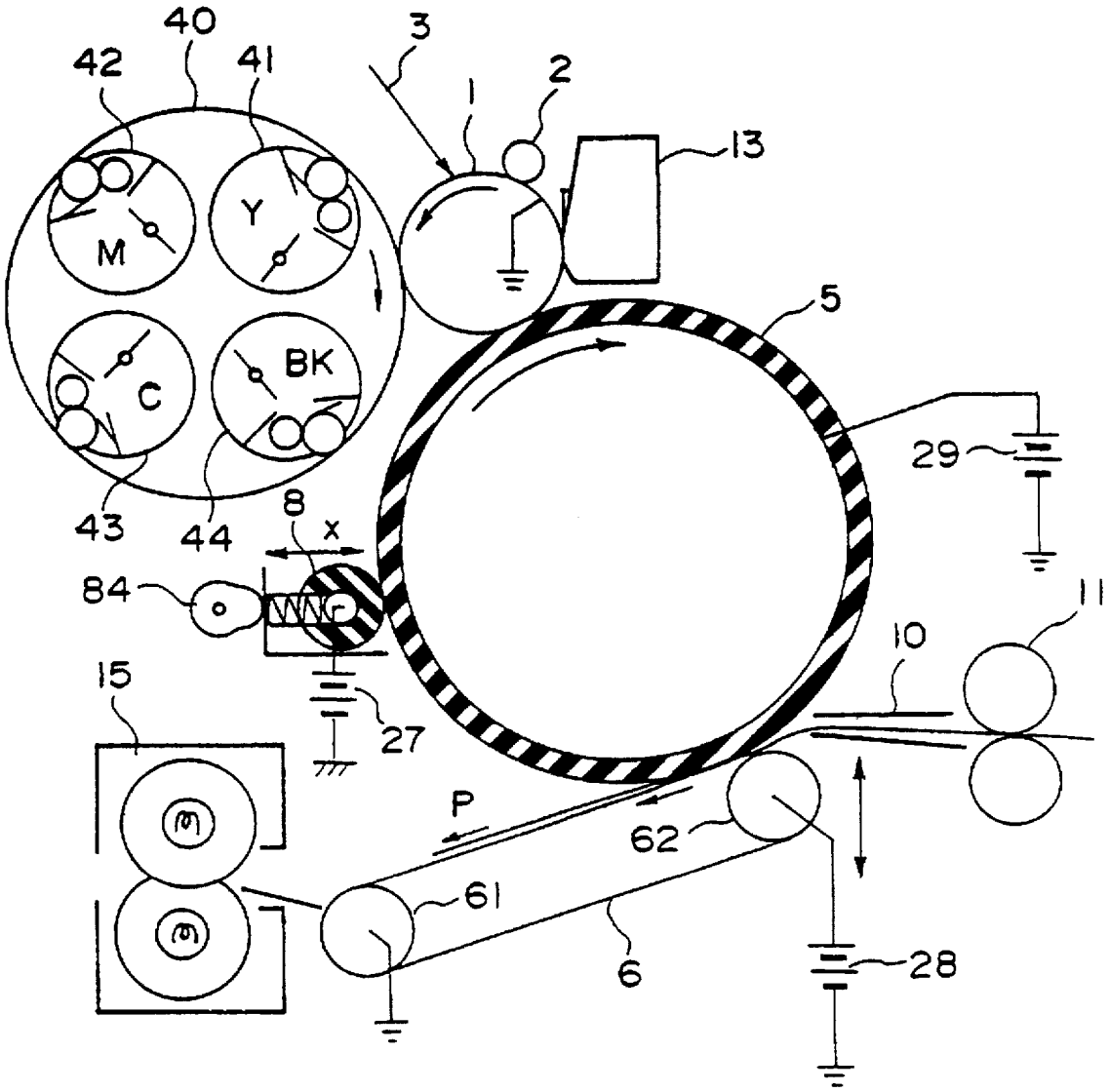
FIG. 1 is a schematic section of the laser printer in the first embodiment of the present invention.

FIG. 1 is a schematic section of a color image forming apparatus (copying machine or laser printer) based on the electro-photographic process. It employs a medium resistance elastic roller 5 as the intermediate transfer member, and a transfer belt 6 as a secondary contact transfer means.

A reference numeral 1 designates an electro-photographic photosensitive member of a rotary drum type (hereinafter, photosensitive drum), which is repeatedly used as an image bearing member. It is rotatively driven at a predetermined peripheral velocity (process speed) in the counterclockwise direction indicated by an arrow mark.

While being rotated, the photosensitive drum 1 is uniformly charged to a predetermined voltage level of a predetermined polarity by a primary charge roller 2. Then, the uniformly charged photosensitive member 1 is exposed to an optical image 3 by an unillustrated exposing means (comprising an optical system for separating the colors of a color original, an optical system for focusing the image, a scanning exposure system for scanning the surface of the photosensitive member with a laser beam modulated in response to sequential digital image signals reflecting image data, or the like), whereby an electrostatic latent image correspondent to the first color component (for example, yellow component) of a target color image is formed.

Next, the electrostatic latent image is developed by a negatively charged yellow (first color) toner Y carried on the development sleeve of a first development device 41 (yellow color development device).

Figure 16:
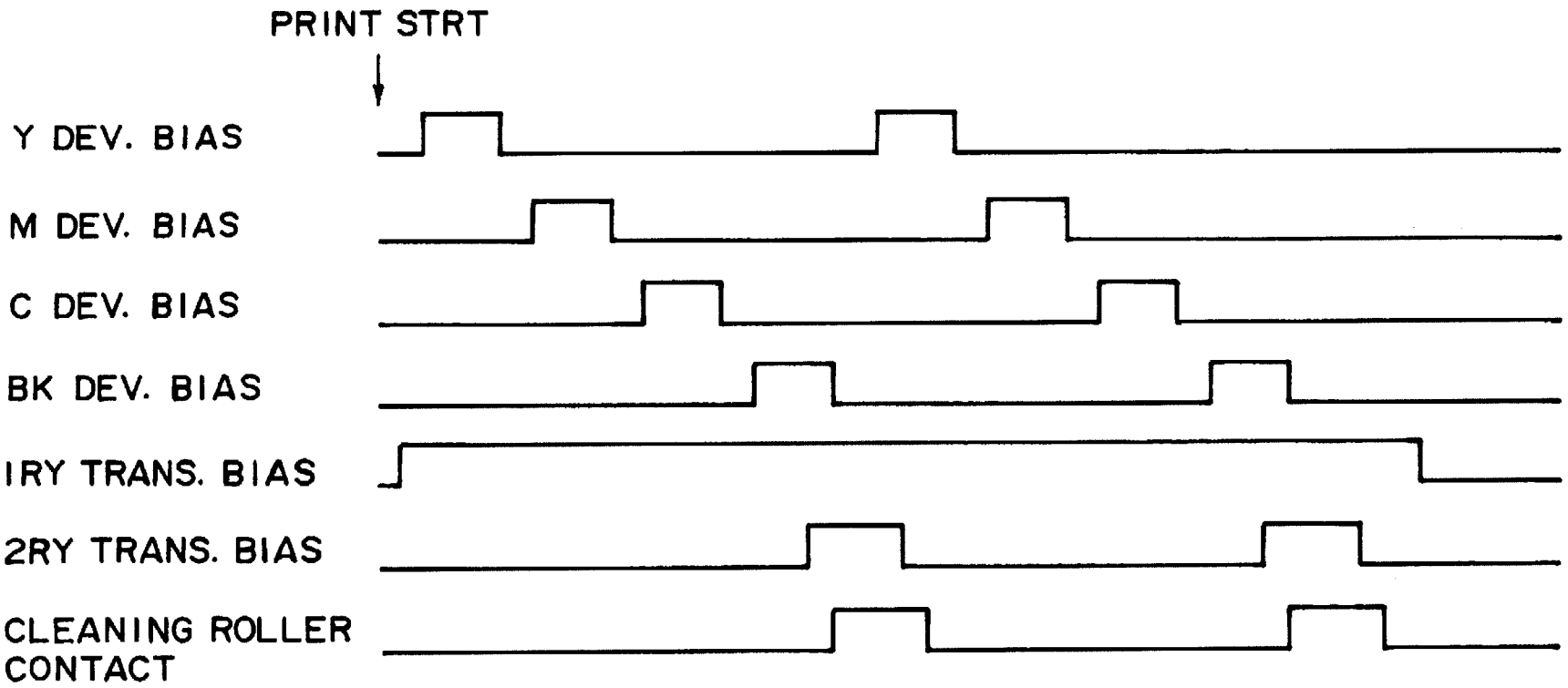
FIG. 16 is an operational sequence diagram for a full color mode of the image forming apparatus in the first embodiment of the present invention.

Referring to FIG. 16, "Y development bias" shows the timing with which a bias is applied to the development sleeve from an unillustrated high voltage source when the electrostatic latent image is developed by the yellow toner; the high level in the chart indicates that the development bias is on, and the low level indicates that it is off. Also in the timing charts which will be presented hereinafter, the logic regarding the high level and the low level shall remain the same.

Development device 41, 42, 43 and 44 (yellow, magenta, cyan and black) are rotatively moved in the direction of an arrow mark by an unillustrated driving apparatus, so that each development device can be positioned to face the photosensitive drum 1.

An intermediate transfer member 5 is rotated in the clockwise direction indicated by an arrow mark, at the same peripheral velocity as the photosensitive drum 1.

As the photosensitive drum 1 is rotated, the aforementioned yellow (first color) toner image formed and borne on the photosensitive drum 1 is moved into the nip formed between the photosensitive drum 1 and the intermediate transfer member 5. In the nip, the yellow (first color) toner image is transferred onto the peripheral surface of the intermediate transfer member 5 by the electric field generated by a primary transfer bias 29 applied to the intermediate transfer member 5, and the pressure in the nip. Hereinafter, this process is referred to as "primary transfer."

Thereafter, a magenta (second color) toner image, a cyan (third color) toner image, and a black (fourth color) toner image are sequentially transferred onto the intermediate transfer member 5, being overlaid on the preceding toner images. As a result, a synthetic color image correspondent to the target color image is formed.

Referring to FIG. 16, "M development bias," "C development bias," or "Bk development bias" shows the timing with which a bias is applied from an unillustrated high voltage source to each development sleeve when the electrostatic latent image is developed with each color toner. "The primary transfer bias" shows the timing with which the primary transfer bias is applied. The primary transfer bias is maintained until the post-cleaning rotation, which will be described later.

A reference numeral 6 designates a transfer belt, which is in contact with the downward facing portion of the intermediate transfer member 5; and is supported by a bias roller 62 and a tension roller 61, which are parallel to the intermediate transfer member 5. To the bias roller 62, a transfer bias of a desirable value is applied from a bias source 28 for the secondary transfer, whereas the tension roller 61 is grounded.

The bias for the primary transfer for sequentially transferring the first to fourth toner images of different colors from the photosensitive drum 1 to an intermediate transfer member 5, in an overlaying manner, has the positive polarity opposite to that of the toner, and is applied from the bias source 29.

While the first to fourth toner images of different colors are being sequentially transferred from the photosensitive drum 1 to the intermediate transfer member 5, the transfer belt 6, and a roller 8 for cleaning the intermediate transfer member 5, are separable from the intermediate transfer member 5.

The cleaning roller 8 is supported at both ends by a spring, and is placed in contact with, or removed from, the intermediate transfer member 5 as the supporting frame is moved horizontally (in the direction of an arrow mark X).

FIG. 1 depicts a state in which the roller 8 is at a point at which it is in contact with the intermediate transfer member 5, but as a cam 84 rotates 180°, the roller 8 is moved to another point (unillustrated) at which it is away from the intermediate transfer member 5.

The toner image composed of the toner having been transferred onto the intermediate transfer member 5 in a overlaying manner is transferred onto a recording medium P in the following manner. The transfer belt 6 is placed in contact with the intermediate transfer member 5, and the recording medium P is delivered, with a predetermined timing, from an unillustrated sheet feeder cassette to the nip formed between the intermediate transfer member 5 and the transfer belt 6, by way of a registration roller 11 and a pre-transfer guide 10. Meanwhile, the bias for the secondary transfer is applied from the bias power source 28 to the bias roller 62. The aforementioned toner image is transferred by this bias for the secondary transfer, from the intermediate transfer member 5 to the recording medium P. Hereinafter, this process is referred to as "secondary transfer".

The recording medium P on which the toner image has been transferred is sent to a fixing device 15, in which the toner image is fused (fixed) to the recording medium P.

The aforementioned secondary transfer is carried out with the timing designated as "bias for the secondary transfer" in FIG. 16. Before the bias for the secondary transfer is applied, the transfer belt 6 is placed in contact with the intermediate transfer member 5, and after the application of the bias for the secondary transfer is stopped, the transfer belt 6 is separated from the intermediate transfer member 5.

Referring to FIG. 16, when an image is sequentially formed one for one on two or more recording mediums by a single input of print start signal from a computer or the like, the timing for the primary transfer and the timing for the secondary transfer partially overlap each other; the secondary transfer is started while the black (fourth color) toner image is still being transferred through the primary transfer process.

After the image transfer onto the recording medium P, the cleaner roller 8 is placed in contact with the intermediate transfer member 5. As a result, the untransferred toner is charged by the roller 8, being thereby returned to the photosensitive drum 1; the intermediate transfer member 5 is cleaned.

"Cleaning roller contact" in FIG. 16 shows the timing for the above contact between the intermediate transfer member 5 and the roller 8.

The cleaning roller 8 is placed in contact with the intermediate transfer member 5, at the charging point, by a cam 84 which is driven by an unillustrated motor through a clutch. As a positive bias is applied to the cleaning roller. 8 from a high voltage power source 27 while the cleaning roller 8 is in contact with the intermediate transfer member 5, the untransferred toner is charged to the positive polarity. Then, this positively charged untransferred toner is transferred back to the photosensitive drum 1 at the same time as the yellow toner image for the following recording medium is transferred onto the intermediate transfer member 5 through the primary transfer process, and is recovered by a cleaner 13, together with the untransferred toner from the primary transfer process.

The cleaning roller 8 is separated from the intermediate transfer member 5 after the trailing end of the residual toner image passes by the cleaning roller 8.

Referring again to FIG. 16, the period in which the cleaning roller 8 is in contact with the intermediate transfer member 5 overlaps with the period for the secondary image transfer onto the preceding recording medium, the period for developing the yellow toner image for the following recording medium, and the period for the primary transfer following the development of the yellow toner image.

Next, the image formation sequence for the last recording medium (second recording medium in FIG. 16) in a continuous image formation mode will be described. During this sequence, in order to clean the residual toner resulting from the secondary transfer, the rotation is continued even after the secondary transfer for the last recording medium, until the trailing end of the intermediate transfer member 5 surface region, in which the residual toner is present, passes the nip formed between the photosensitive drum 1 and the intermediate transfer member 5. During this post-rotation, the application of the primary transfer bias is continued to return the residual toner resulting from the secondary transfer, to the photosensitive drum 1. Also during this post-rotation, the primary transfer does not occur; the toner image is not transferred from the photosensitive drum 1 to the intermediate transfer member 5. Otherwise, this sequence is the same as the image formation sequence for the first recording medium.

Figure 17:
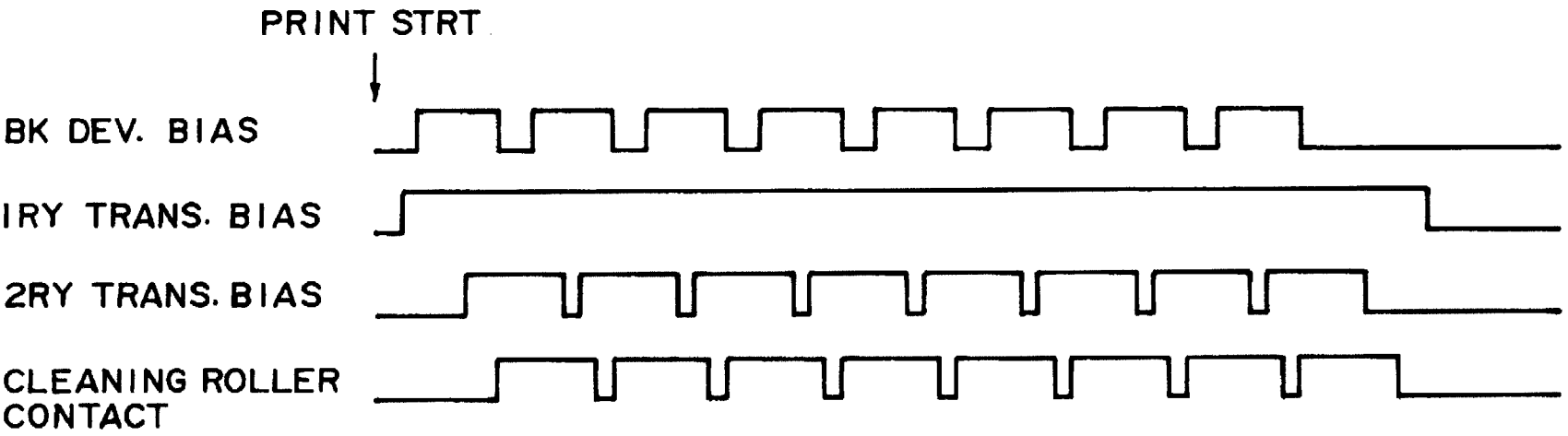
FIG. 17 is an operational sequence diagram for a monochromatic mode of the image forming apparatus in the first embodiment of the present invention.

FIG. 17 presents the sequence for a continuous monochromatic image formation mode in which eight copies are made.

In this case, a portion of the above described full color mode sequence, that is, the portion for the fourth color and thereafter is repeated.

Even the post-rotation which comes after the printing of the last copy is the same as that in the full color mode.

In this embodiment, a primary transfer bias with a predetermined value is continuously applied from the beginning of the printing of the first page to the end of the printing of the last page. However, it may be turned on and off with an appropriate timing, during the secondary transfer for each page.

Also in this embodiment, the mode in which two full color copies are continuously printed, and the mode in which eight monochromatic copies are continuously printed, are described. However, when in an incontinuous mode, that is, when only a single print is made by each image formation start signal, the operation sequence is the same as the printing sequence for the last page in the continuous mode. That is, after producing a single print, the predetermined post-rotation is continued so that the residual toner on the intermediate transfer member is returned to the photosensitive drum 1 through a reversal transfer process, at the same time as the primary transfer.

Hereinafter, the cleaning of the intermediate transfer member 5, which characterizes the present invention, will be described.

The present invention is characterized in that in order to clean the intermediate transfer member 5, the toner remaining on the intermediate transfer member 5 after the secondary transfer is transferred back to the photosensitive drum 1 at the same time as the primary transfer, that is, the toner image transfer from the photosensitive drum 1 to the intermediate transfer member 5, and then, the returned residual toner is recovered by the cleaner 13 of the photosensitive drum 1.

Next, the mechanism for such cleaning will be described. As the secondary transfer bias having a polarity opposite to that of the toner charge (negative polarity) is applied to the bias roller 62, a powerful electric field is generated. The toner image formed on the intermediate transfer member 5 is transferred by this electric field onto the recording medium P delivered to the transfer belt 6.

During this process, a small portion of the toner fails to be transferred onto the recording medium P, remaining on the intermediate transfer member 5 after the secondary transfer. Most of this residual toner from the secondary transfer has the positive polarity, that is, the polarity opposite to that of the normally charged toner (negative).

This does not mean that the charge of all the residual toner from the secondary transfer has been reversed to the positive polarity; a small amount of toner may has been neutralized, carrying no charge, and another small amount of toner may have maintained the negative polarity.

The above assumption was confirmed by conducting the experiments described below.

A monochromatic text pattern and a solid white text pattern were printed in succession using a laser printer structured as depicted in FIG. 1. When the intermediate transfer member cleaning means was not available, a ghost-like pattern of the preceding text pattern, which resulted from the residual toner from the secondary transfer of the preceding text pattern, appeared on the following solid white pattern print. As the secondary transfer bias value was increased or decreased relative to a predetermined value, the appearance of the residual toner ghost varied in response to the bias value changes; it was observed that when the transfer bias value was excessively high, the ghost appearance level was improved.

Incidentally, it has been known that the efficiency with which the toner image is transferred onto the recording medium P peaks with a certain transfer bias value, and that application of an excessive amount of bias reduces the transfer efficiency.

The transfer efficiency observed in the experiments described .above showed otherwise. Therefore, the surface of the intermediate transfer member 5 was examined after the secondary transfer, and also, the surface of the photosensitive drum 1 was examined after the intermediate transfer member passed the primary transfer point of the photosensitive drum a second time, after the secondary transfer. After the application of an excessive amount of the secondary transfer baas, an extremely large amount of the residual toner from the secondary transfer was found on the intermediate transfer member 5, and at the same time, the toner was found on the photosensitive drum 1. The appearance of the toner pattern on the photosensitive drum 1 confirmed that the toner had been transferred back to the photosensitive drum 1 from the intermediate transfer member 5.

Careful studies of the above results confirmed that during the secondary transfer, the toner polarity was reversed from the initial polarity, due to the application of a strong secondary bias.

However, since the residual toner on the intermediate transfer member 5 after the secondary transfer was partially composed of the neutralized toner or the negatively charged toner as described before, not all of the residual toner returned to the photosensitive drum 1, creating a ghost image on the following recording medium when in a continuous printing mode.

As evident from the above description, when the transfer bias is on the higher side of the optimum transfer bias, an excessive transfer current causes image deterioration, preventing the formation of a highly precise image.

Thus, the inventors of the present invention conducted the following experiment. That is, a charge roller 8, which was capable of not only charging the neutralized toner with no charge, but also forcing the toner still maintaining the initial negative polarity to reverse its polarity, was disposed at a point which, relative to the rotational direction of the intermediate transfer member 5, was past the secondary transfer point, but on the upstream side of the primary transfer point.

As a result, substantially all the residual toner from the secondary transfer was returned to the photosensitive drum 1; the inventors of the present invention confirmed that the reversal transfer was possible.

Also, it became evident that when the secondary transfer residual toner was transferred back to the photosensitive drum 1 at the same time as the toner image formed on the photosensitive drum 1 was transferred to the intermediate transfer member 5 through the primary transfer process, the secondary transfer residual toner having been reversed in polarity on the intermediate transfer member 5, and the normally charged toner to be transferred through the primary transfer process, barely neutralized each other in terms of electrical properties, in the nip between the photosensitive drum 1 and the intermediate transfer member 5; the reversely charged toner was transferred back to the photosensitive drum 1, and the normally charged toner was transferred to the intermediate transfer member 5.

As for the reason for the occurrence of the above phenomenon, it is conceivable that the electric field generated at the primary transfer nip between the photosensitive drum 1 and the intermediate transfer member 5 was weakened by the lowering of the primary transfer bias, and therefore, the electrical discharge in the nip was reduced, preventing the occurrence of the toner polarity reversal in the nip.

Further, since the toner had insulating properties, the charge of the toner with the normal polarity, and the charge of the toner with the reverse polarity, did not respond to each other in a short time; neither was the toner polarity reversed nor neutralized.

Therefore, the secondary transfer residual toner on the intermediate transfer member 5, which had been forcefully charged to the positive polarity by the aforementioned cleaning roller 8, was transferred back to the photosensitive drum, and at the same time, the toner on the photosensitive drum 1, which had been charged to the negative polarity, was transferred to the intermediate transfer member 5. In other words, two groups of toner reacted independently of each other.

Thus, in this embodiment, the image formation start signal was inputted only once from an outside source such as a computer or the like, in order to continuously form a monochromatic toner image on two or more recording mediums P, wherein a reversal transfer process for reversely transferring the secondary transfer residual toner after the completion of the secondary transfer, and a normal transfer process for transferring a toner image from the photosensitive drum 1 to the intermediate transfer member 5 so that the toner image can be transferred onto the next recording medium P, are carried out at the same time. In other words, an image is continuously formed on a predetermined number of recording mediums P while transferring the residual toner on the intermediate transfer member 5 to the photosensitive drum 1; therefore, the time necessary to output the predetermined number of prints can be reduced.

Further, when an image is formed on only a single recording medium P by a single image formation start signal, the intermediate transfer member 5 is cleaned by reversely transferring the secondary transfer residual toner remaining on the intermediate transfer member 5 to the photosensitive drum 1 without the occurrence of the image transfer from the photosensitive drum i to the intermediate transfer member 5 after the secondary transfer.

In this embodiment, a contact type charging means was employed as a charging means for charging the secondary transfer residual toner on the intermediate transfer member 5. More specifically, an elastic roller comprising two or more layers was employed as the intermediate transfer member cleaning roller 8.

Figure 2:
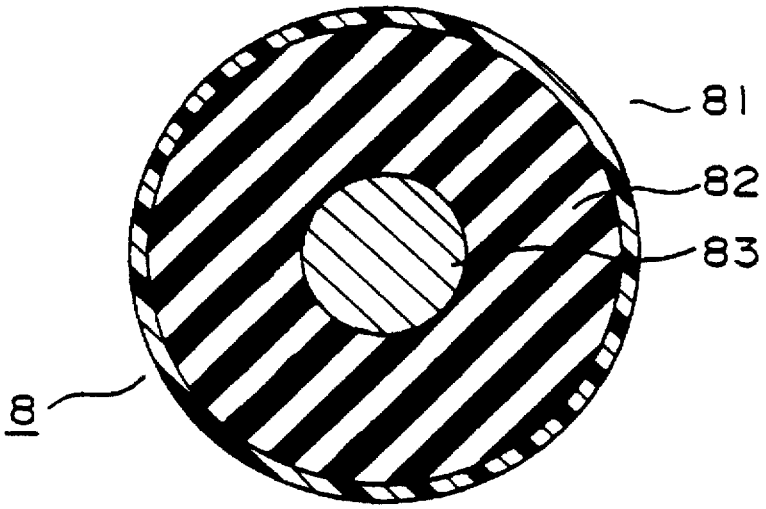
FIG. 2 is a schematic section of the cleaning roller for cleaning the intermediate transfer member employed in the laser printer of the first embodiment.

FIG. 2 presents a schematic section of the intermediate transfer member cleaning roller 8 actually employed in this embodiment.

The cleaning roller 8 employed in this embodiment comprises an electrically conductive, cylindrical base member 83, an elastic layer 82 placed on the base member 83, and one or more covering layers 81 covering the elastic layer 82. The elastic layer 82 is composed of rubber, elastomer, or the like resins.

The material for the electrically conductive base member 83 in the cylindrical form has only to be such material that is rigid enough not to allow the cleaning roller 8 to flex so that the cleaning roller 8 can be kept in contact with the intermediate transfer member 5, evenly across the entire length of the nip. For example, metallic material such as aluminum, iron, or copper, alloy material such as stainless steel, or electrically conductive resin in which carbon, metallic particle, or the like is dispersed, may be employed.

The elastic layer 82 has only to have a hardness sufficient to keep the cleaning roller 8 in contact with the intermediate transfer member 5 without leaving any gap between the two components, and a certain degree of electrically insulating properties relative to the bias to be applied.

More specifically, the following rubber material can be listed: acrylonitrile-butadiene-rubber (NBR), styrene-butadiene rubber, butadiene rubber, ethylene-propylene-rubber, chloroprene rubber, chlorosulfonated-polyethylene, chlorinated polyethylene, acrylonitrile-butadiene rubber, acrylic rubber, fluorocarbon rubber, urethane rubber, urethane sponge, and the like. The resistance value is desirable to be $10^5$–$10^{11}$ Ω/cm, preferably, $10^5$–$10^7$ Ω/cm (when a voltage of 1 kV is applied), in volumetric resistance. The overall resistance value of the intermediate transfer member cleaning roller 8 will be described later.

The material selection for the covering layer 81 is one of the essential factors in terms of intermediate transfer member cleaning. This is because the function required of the intermediate transfer member cleaning roller 8 is the same as that of the charge roller for charging the surface of the photosensitive drum 1.

The charge roller for charging the surface of the photosensitive drum may be a roller with only a single layer as long as its resistance value is extremely stable, and its surface is void of minute irregularities in resistance, so that it can satisfactorily function. This is because the charging effect is dependent on the electrical discharge which occurs between the surface material of the photosensitive drum and the surface material of the charge roller when a voltage is applied between the two materials, and the electrostatic capacity which contributes to the electrical discharge is determined by the resistance value.

Therefore, in order to control the resistance, and also to suppress the effects of the minute resistance irregularities present on the surface of the roller, the roller is preferred to be structured in two layers so that two functions are separately handled, that is, the resistance value is roughly controlled by the elastic layer 82, the lower layer, and is finely controlled by the covering layer 81, the surface layer. Also, this arrangement is preferable from the standpoint of manufacturing, for example, latitude in material selection, cost, and the like.

Accordingly, the two layer structure is employed in this embodiment. As for the material to be used for the covering layer 81, compound material composed of resin material such as nylon resin, urethane resin, or fluorocarbon resin, and metallic oxide such as titanium oxide or tin oxide which is dispersed in the resin material to control the resistance, is preferable.

The covering layer may be a type of resin sheet which is wrapped over the elastic layer 82.

The covering layer must have appropriate resistance for allowing the occurrence of electrical discharge when the roller 8 is placed in contact with the intermediate transfer member 5. More specifically, a resistance value within a range of $10^6$–$10^{15}$ Ω/cm (when 1 kV is applied) is effective.

The surface resistance is measured in the following manner. A sample of the covering layer 8 is composed of an electrically conductive sheet with a size of 100 mm×100 mm, and a surface layer coated thereon under similar conditions, and the resistance of this sample is measured with an R8340A and an R12704 of Advantest Corp. The voltage to be applied is 1 kV, wherein the discharge time and the charge time are 5 seconds and 30 seconds, respectively, and the measuring time is 30 seconds.

The intermediate transfer member cleaning roller 8 employed in this embodiment comprises a metallic core of stainless steel, an elastic member 82 of urethane sponge, and a covering layer 81. The external diameter of the metallic core is 14 mm. The thickness (t) and volumetric resistivity of the elastic layer 82 are 3 mm and $10^5$ Ω/cm (when 1 kV is applied), respectively. The covering layer 81 is composed of polyamide methoxylate in which titanium oxide is dispersed. Its thickness and surface resistance value are 10 μm and $10^{13}$Ω, respectively. Its external diameter is approximately 20 mm.

Figure 5:
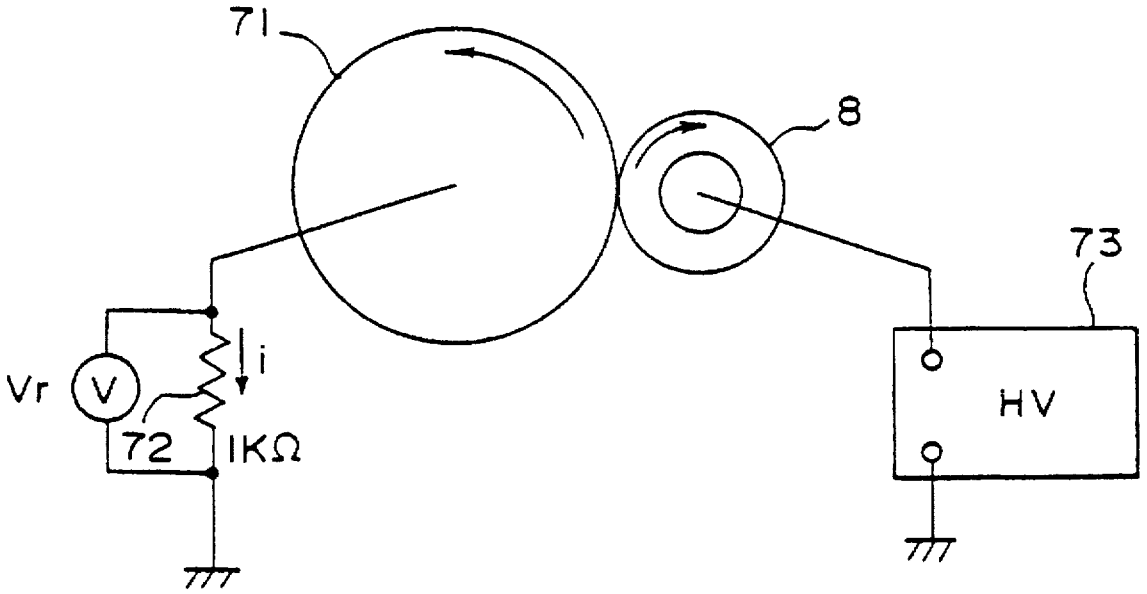
FIG. 5 is a schematic section of an instrument for measuring the resistances of the intermediate transfer member cleaning roller and the intermediate transfer member in accordance with the present invention, under an actual usage condition.

The resistance of the aforementioned roller 8 in terms of actual usage is measured using the method depicted in FIG. 5. Here, "resistance in terms of actual usage" means an overall resistance of the intermediate transfer member cleaning roller 8 including the elastic layer 82, the covering layer 81.

Referring to FIG. 5, an aluminum cylinder 71 is rotatively driven by an unillustrated driving force source such as a motor, and the cleaning roller 8 follows the rotation of the aluminum cylinder 71. The contact pressure between the two components is set up to be substantially the same as when the cleaning roller 8 is disposed in the apparatus illustrated in FIG. 1. The overall contact pressure is 1 Kgf. A stable DC voltage Vdc is applied from a high voltage power source 73 to the metallic core of the cleaning roller 8. The current which flows through the elastic layer 82 and covering layer 81 of the cleaning roller 8 flows into the aluminum cylinder 71, and then, flows to the ground through a standard resistor 72. When the voltage Vr between the two ends of the standard resistor 72 is Vr [V], the resistance value Rc of the cleaning roller 8 is obtained from the following formula:

$$Rc\ [\Omega]=10^6/Vr\ [V]$$

The obtained resistance of the cleaning roller 8 in terms of actual usage was $4\times10^8$Ω.

After careful studies, the inventors of the present invention discovered that the preferable resistance value of the cleaning roller 8 in terms of actual usage was within a range of $5\times10^5$–$1\times10^{10}$ Ω/cm, more preferably, $10^8$–$10^{10}$ Ω/cm as measured using the aforementioned method.

It was also confirmed that the covering layer 81 was more effective when its thickness was 5–100 μm.

Next, the intermediate transfer member 5 employed in this embodiment will be described with reference to FIG. 3.

The intermediate transfer member 5 employed in this embodiment is in the form of a roller. It comprises an electrically conductive, cylindrical base member, and at least an elastic layer composed of rubber, elastomer, or the like material, and a surface layer laid on the elastic layer. The surface layer further comprises two or more sub-layers.

Figure 3:
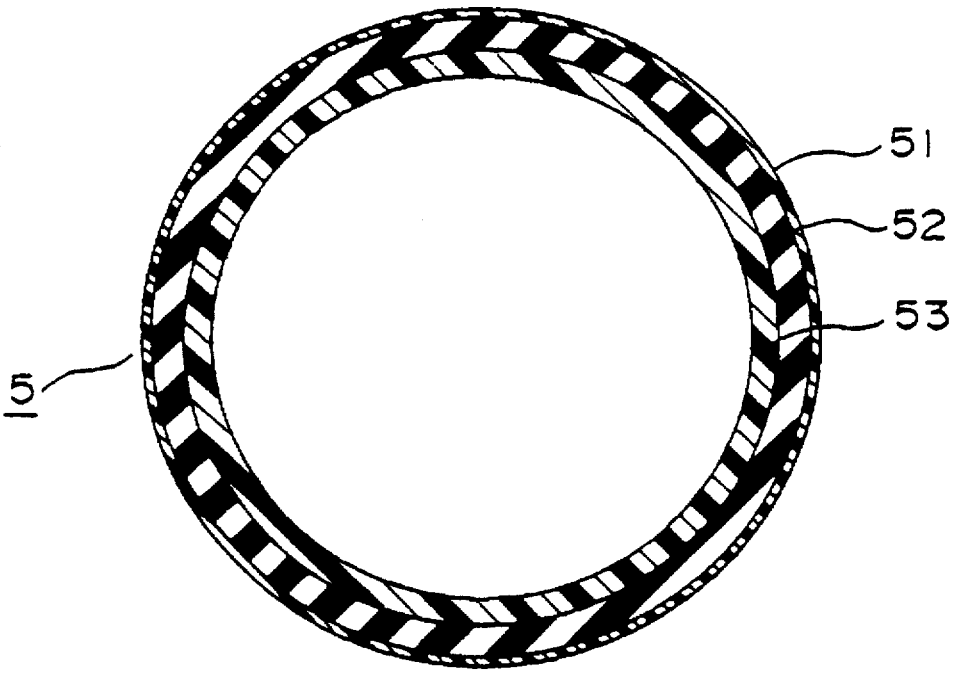
FIG. 3 is an enlarged sectional view of the intermediate transfer member.

FIG. 3 is a schematic section of the intermediate transfer member 5, wherein a reference numeral 53 designates the electrically conductive, cylindrical base member; 52, the elastic layer; and 51 designates the surface layer.

As for the material for the electrically conductive, cylindrical base member 53, electrically conductive resin material, in which particles of metallic material such as aluminum, iron, or copper, particles of alloy material such as stainless steel, particles of carbon, or the like particles are dispersed, may be employed. As for the structure of the cylindrical base member 53, it is in the form of the aforementioned cylinder, wherein a central shaft may penetrate through the longitudinal axis of the cylinder, or reinforcement material may fill the interior space of the cylinder. The metallic core employed in this embodiment is constituted of a 3 mm thick aluminum cylinder, and the reinforcement material is disposed within the internal void.

The thickness of the elastic layer 52 of the intermediate transfer member 5 is preferred to be 0.5–7.0 mm in consideration of the formation of the transfer nip, the rotational color misalignment, the material cost, and the like factors. The surface layer 51 is preferred to be thin enough to allow the effects of the elasticity of the elastic layer 52, that is, the underlayer, to reach the surface of the photosensitive drum 1 through the surface layer 51. Preferably, it is 5–100 μm. In this embodiment, the thicknesses of the elastic layer 52 and the surface layer 51 of the intermediate transfer member 5 are 5 mm and 10 μm, respectively, and the overall external diameter is 180 mm.

Further, with emphasis placed only on the resistance value of the elastic layer 52, acrylonitrile-butadiene rubber (NBR) is used as the material for the elastic layer 52, and Ketchen black is dispersed therein to control the resistance.

The resistance of the elastic layer 52 alone is measured using a resistance measuring jig having substantially the same structure as that of the apparatus illustrated in FIG. 5 which is used to measure the aforementioned intermediate transfer member cleaning roller 8 in terms of actual usage. According to the studies, the desirable resistance range of the basis layer of the intermediate transfer member is $1\times10^4 1\times10^7$ Ω/cm (when 1 kV is applied). In this embodiment, a resistance of $1\times10^6$ Ω/cm is was selected.

Further, the same material as that used for the elastic layer 82 of the aforementioned intermediate transfer member cleaning roller 8 may be listed as the rubber material usable for the elastic layer 52. As for the electrically conductive material, carbon black, aluminum particles, nickel particles, and the like may be employed. Further, it is conceivable to employ electrically conductive resin instead of dispersing electrically conductive agent into non-conductive resin. As for specific names of the usable conductive materials, it is possible to list polymethyl methacrylate containing fourth-class ammonium salt, polyvinyl aniline, polyvinyl pyrrol, polydiacetylene, polyethylene imine, and the like.

The volumetric resistance is measured in the following manner. The aforementioned elastic layer 52 is cut out in a size of 100 mm×100 mm, with an optional thickness, and the volumetric resistance of this piece is measured using an R8340A and an R12704 of Advantest Corp. As for the measurement conditions, the applied voltage is 1 kV; the discharge time, 5 seconds; the charge time, 30 seconds; and the measurement time is 30 seconds.

The surface layer 51 of the intermediate transfer member 5 is important since it greatly affects the efficiency with which the secondary transfer residual toner is cleaned. As for the material for the surface layer 51, urethane resin is used as binder, in which aluminum boride whisker is dispersed as the conductive material for controlling resistance, and PTFE powder is dispersed to improve mold releasing properties.

The resistance of the above surface layer is measured using the same method. It is $10^{12}$ Ω/cm (when 1 kV is applied). After careful studies, the inventors of the present invention discovered that when the surface layer resistance was within a range of $10^8$–$10^{12}$ Ω/cm, a preferable cleaning performance could be obtained.

The combined resistance of the elastic layer 52 and the surface layer 51 in terms of actual usage is $10^7$ Ω/cm (when 1 kV was applied). Also, the resistance of the intermediate transfer member 5 in terms of actual usage is measured using the same method as that used to measure the aforementioned intermediate transfer member cleaning roller 8, including the measuring system depicted in FIG. 5.

Next, the toner employed in this embodiment will be described.

The toner employed in the studies described in this embodiment is nonmagnetic single component polymer toner. It contains, by 5–30 wt %, material with a low softening point which is manufactured using suspension polymerization, and its shape factor SF1 is 100–120. Its particles are substantially spherical, and the particle diameter is 5–7 μm.

It is said that as the toner particle shape becomes infinitely closer to being a sphere, transfer efficiency improves. This is thought to be due to the fact that as the toner particle shape becomes infinitely closer to being a sphere, the surface energy of each toner particle becomes smaller, and as a result, the fluidity of the toner increases, weakening thereby the force (mirror force) adhering the toner to the photosensitive drum or the like, and the toner becoming more susceptible to the effects of the transfer electric field.

Figure 6:
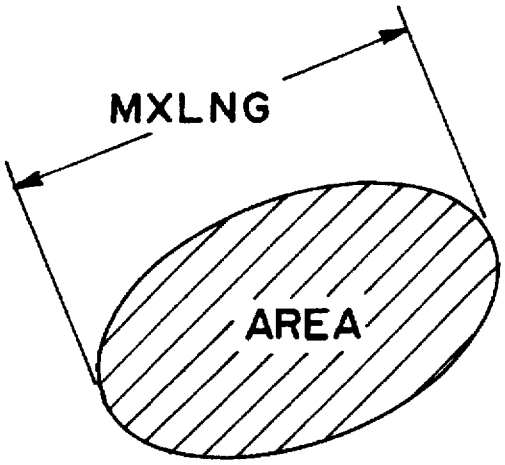
FIG. 6 is an explanatory drawing describing a shape factor SF1.

Referring to FIG. 6, the shape factor SF1 mentioned in the foregoing is a value which indicates the roundness ratio of a spherical object. It is obtained in the following manner; the square of the maximum length MXLNG of an elliptic figure obtained by projecting a spherical object on a two dimensional flat surface is divided by the area size AREA of the elliptic figure, and the quotient is multiplied by $100\pi/4$.

In other words, the shape factor SF1 is defined by the following formula:

$$SF1=\{(MXLNG)^2/AREA\}\times(100\pi/4)$$

Figure 7:
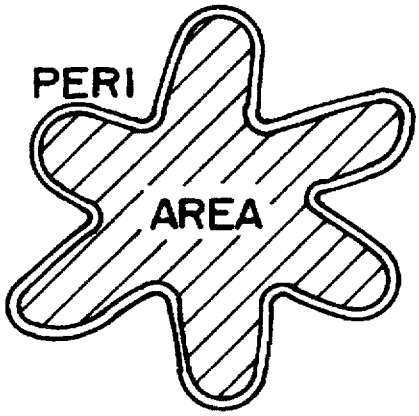
FIG. 7 is an explanatory drawing describing a shape factor SF2.

Referring to FIG. 7, the shape factor SF2 is a numerical value which indicates, in ratio, configurational irregularity of an object. It is obtained in the following manner; the circumference PERI of a figure obtained by projecting an object onto a two dimensional flat surface is divided by the area size AREA of the figure, and the obtained quotient is multiplied by $100\pi/4$.

In other words, the shape factor SF2 is defined by the following formula:

$$SF2=\{(PERI)2/AREA\}\times(100\pi/4)$$

In this embodiment, SF1 and SF2 are obtained as follows. Toner images were randomly sampled using an FE-SEM (S-800), a product of Hitachi, Ltd., and the obtained data are introduced into an image analysis apparatus (LUSEX3), a product of NIKORE Corp. Then, the final values were obtained from the above formulas.

Figure 4:
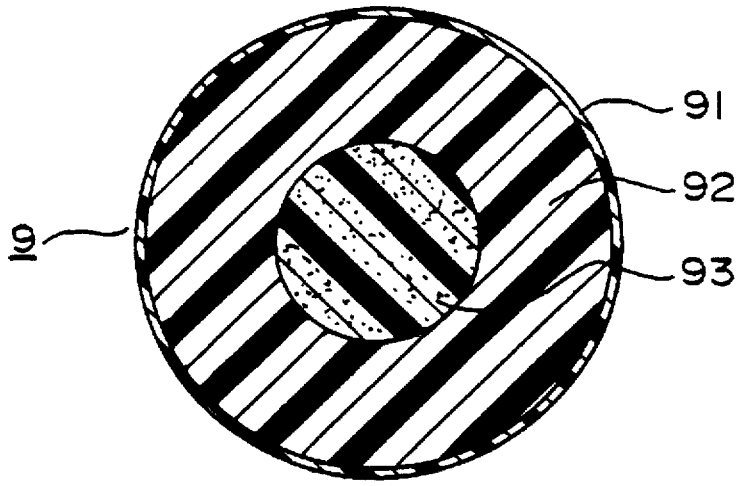
FIG. 4 is a sectional view of the polymer toner employed in the present invention.

FIG. 4 schematically depicts the particle structure of the aforementioned polymer toner.

Because of the toner manufacturing method employed in this embodiment, the polymer toner particle 9 of this embodiment becomes spherical. It comprises a core 93 of ester wax, a resin layer 92 of styrene-butylacrylate, and a surface layer 91 of styrene-polyester. Its specific weight is approximately 1.05. The three layer structure is given for the following reason; the presence of wax core 93 is effective to prevent offset from occurring during the fixing process, and the surface layer 91 of resin material is provided for improving charge efficiency. It should be noted here that in actual usage; oil treated silica is added to stabilize the triboelectric charge.

The triboelectric charge (Q/M) of the above toner employed in this embodiment is approximately −20 μC/g.

The photosensitive drum 1 employed in this embodiment is composed of OPC, and has an external diameter of 60 mm. It comprises a 0.2–0.3 μm thick carrier generation layer, and a 15–25 μm thick carrier transfer layer (hereinafter, CT layer) laminated thereon. The carrier generation layer is composed of phthalocyanine compound, and the CT layer is composed of polycarbonate (hereinafter, PC), that is, a binder, and a hydrazone compound dispersed therein.

In this embodiment, a transfer belt 6 is employed as the secondary transfer means. It does not matter whether or not a bias roller 62 and a tension roller 61, which support the transfer belt 6, are made of the same material or different material. In this embodiment, NBR with a volumetric resistivity of $5\times10^7$ Ω·cm (when 1 kV is applied) is employed. Its hardness is 30°–35° in JIS A. Both rollers comprise a SUS core with a diameter of 8 mm, wherein the surface layer is placed so that the external diameter of each roller becomes 20 mm.

Regarding the material for the above roller 62, selection is optional as long as the volumetric resistivity is within a range of $1\times10^4$ –$1\times10^9$ Ω/cm (when 1 kV is applied), and voltage dependency (tendency to lose resistance when a high voltage is applied) is not extremely unfavorable. In other words, in addition to the material employed in this embodiment, other material such as EPDM, urethane rubber, or CR, in which appropriate conductive agent can be dispersed, may be employed.

The transfer belt 6 is in the form of a tube, which is 80 mm in diameter; 300 mm in length; 100 μm in wall thickness; and $10^8$–$10^{15}$ Ω/cm in volumetric resistivity (when 1 kV is applied).

In this embodiment, a resin belt is employed as the transfer belt 6. It is made of compound material containing polycarbonate denatured by silicon, and carbon dispersed therein to control the volumetric resistivity and the surface resistance; the former is $10^{11}$ Ω/cm, and the latter is $10^{12}$–$10^{13}$Ω.

The following materials can be listed as other materials usable for the transfer belt 6. As for the resin materials, there are polycarbonate (PC), nylon (PA), polyester (PET), polyethylene naphthalate (PEN), polysulfon (PSU), polyethersulfon (PEI), polyetherimide (PEI), polyethernitrile (PEN), polyether-etherketone (PEEK), thermoplastic polyimide (TPI), thermo-hardening polyimide (PI), PES alloy, polyvinylidene fluoride (PVdF), ethylene-tetrafluoroethylene copolymer (ETFE), and the like. As for the elastomer materials, there are polyolefin thermoplastic elastomer, polyester thermoplastic elastomer, polyurethane thermoplastic elastomer, polyurethane thermo-hardening elastomer, polystyrene thermoplastic elastomer, polyamide thermoplastic elastomer, fluorocarbon thermoplastic elastomer, polybutadiene thermoplastic elastomer, polyethylene thermoplastic elastomer, ethylene-vinyl acetate copolymer thermoplastic elastomer, polyvinyl chloride thermoplastic elastomer, and the like.

As for other conditions, the-contact pressure applied to the photosensitive drum 1 by the intermediate transfer member 5 is 3 Kgf. The contact pressure applied to the intermediate transfer member 5 by the cleaning roller 8 is 1 Kgf. The contact pressure applied to the intermediate transfer member 5 by the transfer belt 6 is 5 Kgf.

Dark potential on the photosensitive drum (potential given by the primary charge):

Vd=600 V

Light potential on the photosensitive drum (potential of the spot exposed to laser beam):

V1=250 V

Development method: jumping development using non-magnetic single component developer Development bias: Vdc=−400 V; Vac=1600 Vpp; frequency=1800 Hz Process speed: 120 mm/sec Primary transfer bias: +100 V The aforementioned components are installed into the laser printer illustrated in FIG. 1, and the intermediate transfer member cleaning performance is confirmed under the conditions detailed in the foregoing.

The cleaning roller 8 is placed in contact with the intermediate transfer member 5 after the secondary image transfer from the intermediate transfer member 5 to the recording medium P begins, but before the photosensitive drum surface point at which the leading end of the toner image being transferred onto the intermediate transfer member 5 reaches the contact point between the intermediate transfer member 5 and the cleaning roller 8, and charges to the positive polarity the toner remaining on the intermediate transfer member 5 without having been transferred onto the recording medium P. When image formation is in a continuous mode, this secondary transfer residual toner having been charged to the positive polarity is reversely transferred to the photosensitive drum 1 at the primary transfer station at the same time as the primary transfer for transferring the yellow (first color) toner image onto the intermediate transfer member 5 from the photosensitive drum 1, and then is recovered by the cleaner 13 of the photosensitive drum 1. However, when the second color toner image and the color toner images thereafter are transferred, in an overlaying manner, onto the intermediate transfer member 5 on which the yellow toner image had been transferred, the cleaning roller 8 is not placed in contact with the intermediate transfer member 5. In other words, during the primary transfers for the second toner color image and the color toner images thereafter, the reversal transfer process is not carried out. This is because the contact between the cleaning roller 8 and the intermediate transfer member 5 causes toner image disturbance.

Figure 8:
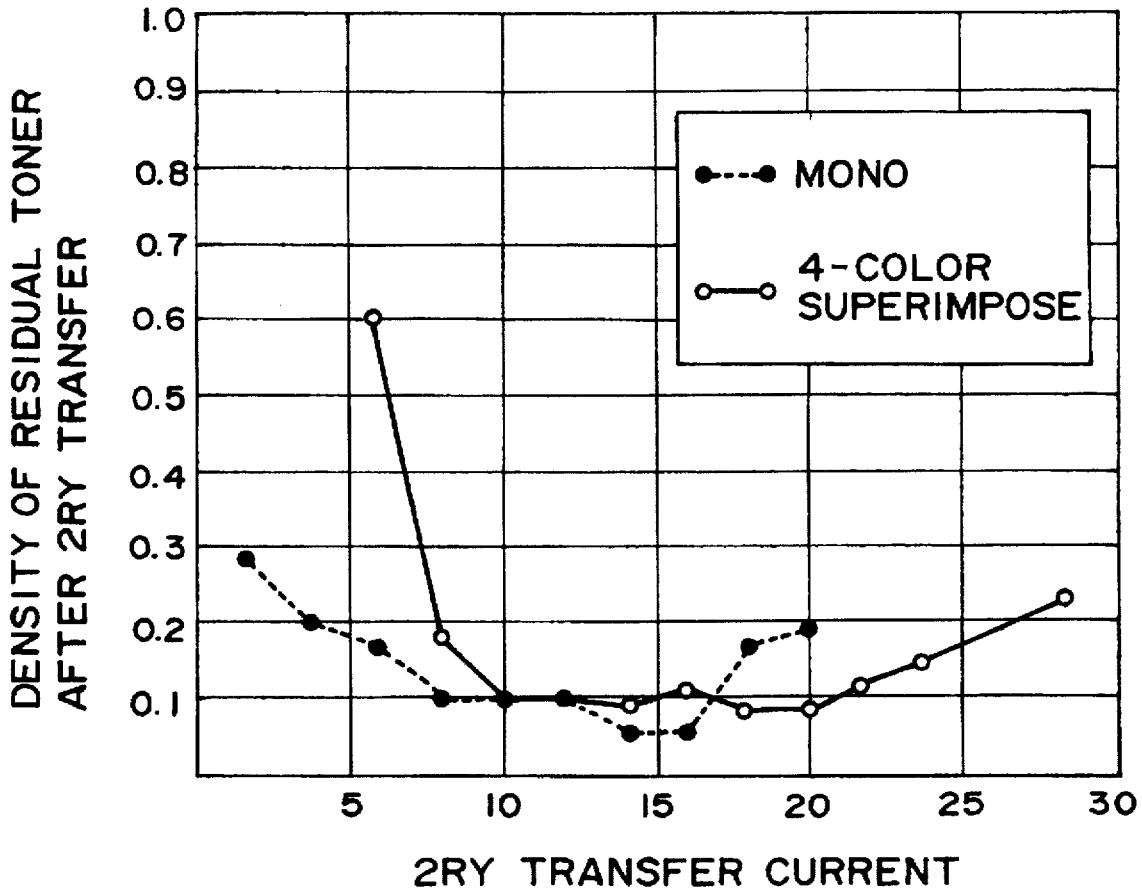
FIG. 8 is a graph showing the relationship between the second transfer current, and the density of the toner remaining on the intermediate transfer member after the second transfer, in the laser printer employed in the description of the present invention.

The graph in FIG. 8 shows that the density of the toner remaining on the intermediate transfer member 5 after the secondary transfer is dependent on the secondary transfer bias value. The density of the toner remaining on the intermediate transfer member 5 is measured using the taping method and a Macbeth densitometer.

It is obvious from FIG. 8 that whether the image transferred onto the recording medium P is a monochrome image or a multi-color (four color) image, the amount of the residual toner on the intermediate transfer member 5 after the secondary transfer becomes minimum when a secondary transfer current is within a range of 10–15 μA; in other words, the transfer efficiency becomes maximum. The amount of the toner M/S [mg/cm$^2$] transferred onto the intermediate transfer member 5 through the primary transfer process is 0.5 [mg/cm$^2$] in the case of the monochromatic image, and 1.4 [mg/cm$^2$] in the case of multi-color (four color) image.

Obviously, in order to clean the intermediate transfer member with preferable results, the amount of the residual toner on the intermediate transfer member 5 is preferred to be as small as possible.

When the amount of the residual toner is large, a large force is necessary to return the residual toner to the photosensitive drum 1 through the process of charging the residual toner by the cleaning roller 8; therefore, it becomes necessary to apply a strong transfer electric field. However, when a strong electric field is applied to the intermediate transfer member 5 for the purpose of the reverse transfer, the toner which has been charged to the reverse polarity (positive) through the secondary transfer process is charged to a higher level, causing toner particles with an abnormally high level of charge to appear among the residual toner particles on the intermediate transfer member 5.

Figure 10:
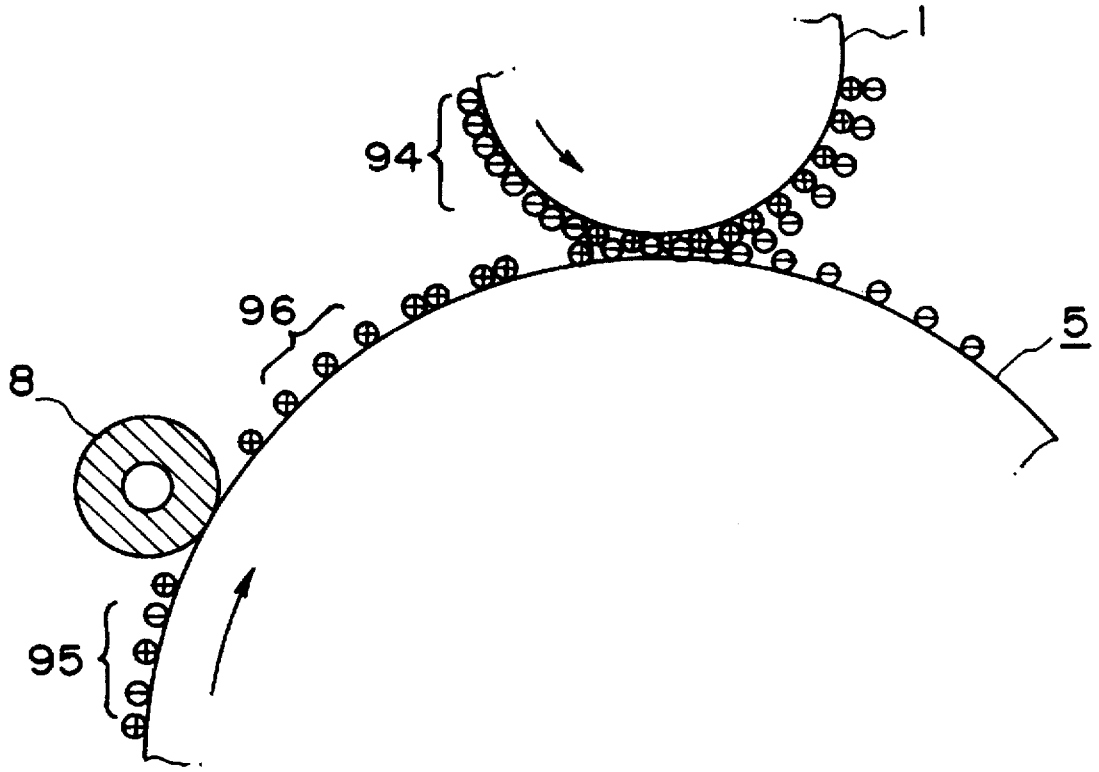
FIG. 10 is an explanatory drawing depicting a mechanism through which a negative ghost related to the cleaning of the intermediate transfer member is created.

FIG. 10 schematically depicts the above described phenomenon.

The above described phenomenon will be described with reference to FIG. 10. When the average value Q/M [μC/g] of the triboelectric charge of the toner particles 94 on the photosensitive drum 1 before the primary transfer process is approximately −20 [μC/g], it will show no change immediately after the primary transfer process. This is because the primary transfer bias is +100 V, which is rather low. The primary transfer bias is set at this level because it was confirmed that when the primary transfer bias is increased, a small portion of the toner is changed in polarity, reducing the secondary transfer efficiency. Thus, the primary transfer bias is set at the aforementioned value in order to improve the secondary transfer efficiency.

The toner transferred onto the intermediate transfer member 5 through the primary transfer process is transferred onto the recording medium P through the secondary transfer process while maintaining the triboelectrical charge of approximately −20 [μC/g]. During this secondary transfer process, the toner is transferred using an optimum secondary transfer bias which is set at a relatively higher level in order to improve the secondary transfer efficiency.

The polarities of most of the toner particles 95 remaining on the intermediate transfer member 5 after the secondary transfer process had been reversed through the secondary transfer process. The average value of the triboelectric charge of the toner on the intermediate transfer member 5 after this polarity reversal was measured; it was +10–+20 [μC/g].

Further, when the polarity of almost all of the residual toner particles 95 had been changed to the polarity opposite to that of the toner particles 94 by the application of an optional bias to the cleaning roller 8, the average value of the triboelectric charge of the toner particles 96 having been charged by the cleaning roller 8 increased to +40–+50 [μC/g].

As described above, the residual toner is positively charged to a higher level. Consequently, the residual toner returns to the photosensitive drum through the reverse transfer process.

However, when the amount of the toner 95 is large, or when there are toner particles positively charged to an abnormally high level in the toner 96, a certain number of toner particles in the toner 94 transferring onto the intermediate transfer member 5 through the primary transfer process are pulled back to the photosensitive drum 1 by the toner 96 transferring onto the photosensitive drum 1 through the reverse transfer process.

When prints are continuously produced under the above condition, the trace of the toner image from the preceding print appears, as a ghost, on the following prints. This phenomenon is called "cleaning ghost" by the inventors of the present invention.

Thus, in order to clean the intermediate transfer member 5 in accordance with the present invention, the amount and charge level of the toner 96 to be returned to the photosensitive drum 1 must be controlled to some degree so that cleaning failure does not occurs nor does the negative ghost appear. The inventors of the present invention attempted to find an appropriate control range by conducting an experiment in which the secondary transfer bias value, and the value of the bias applied to the intermediate transfer member cleaning roller 8, were varied.

Referring again to FIG. 8, it is evident that the amount of the secondary transfer residual toner becomes smallest when the secondary transfer bias is approximately 10–15 μA; in other words, the bias range of 10–15 μA is the appropriate range. Therefore, the bias value was selected-from this range.

The level to which the toner 96 is charged by the roller 8 is controlled by changing the setting of the value of the bias applied to the intermediate transfer member cleaning roller 8.

FIG. 9 is a table presenting the results of an experiment in which the degree of cleaning failure, and the latitude of the negative ghost, were observed while varying the value of the bias applied to the cleaning roller 8. In this experiment, the bias value for the secondary transfer was 12 μA.

Also referring to FIG. 9, in the monochromatic output mode (an image is outputted on the recording medium using only a single toner), the cleaning failure occurred when the value of the bias applied to the cleaning roller was within a range of 0–5 μA, and the negative ghost image appeared when the value of the same was no less than 40 μA. In the four color superimposition mode, the cleaning failure occurred when the value of the aforementioned bias was in a range of 0–10 μA, and the negative ghost image appeared when the value of the same was no less than 50 μA.

Also as evident from FIG. 9, the latitude of the conditions for preventing the occurrence of the aforementioned cleaning failure and the negative ghost shifts depending on whether the image formation is in the monochromatic mode or in the four color superimposition mode. This is because the amount of the toner to be transferred is different, and therefore, the electric field to which the toner is subjected during the secondary transfer process is different in intensity. In other words, when in the monochromatic mode, almost all the toner is charged to the reverse polarity through the secondary transfer process, enhancing the reversely transferring effect of the intermediate transfer member cleaning bias, but when in the four color superimposition mode, the amount of the toner to be transferred onto the intermediate transfer member 5 through the primary transfer process is large, and therefore, the effect of the intermediate transfer member cleaning bias is slightly weakened.

Therefore, when the cleaning bias value is set within a range of 20–30 μA in both the monochromatic mode and the four color superimposition mode, the residual toner on the intermediate transfer member can be cleaned without triggering the cleaning failure or the appearance of the negative ghost, at the same time as the primary transfer process.

When 100,000 A4 size (JIS) copies were continuously printed using the aforementioned laser printer which comprised the charging means 8 of the elastic charge roller type described in this embodiment, and in which the intermediate transfer member cleaning process described in this embodiment was carried out, no image formation failure resulting from the intermediate transfer member cleaning failure occurred at all. In addition, no wear could be observed on the cleaning roller 8 itself because it followed the rotation of the intermediate transfer member 5. Further, the contamination of the cleaning roller 8 by the adhering toner was minimum, causing no trouble.

As described above, according to this embodiment of the present invention, the residual toner on the intermediate transfer member can be cleaned at the same time as the toner remaining on the photosensitive drum after the primary transfer process is cleaned; therefore, when two or more prints can be produced in a continuous printing mode using a color laser printer, a color copying machine, or the like, it is unnecessary to insert a separate cleaning step for cleaning the residual toner on the intermediate transfer member 5, after each print is outputted. As a result, the time necessary for such an operation can be greatly reduced.

Further, according to the present invention, a mechanism for conveying the recovered toner, a complicated cleaning mechanism, a container for collecting the residual toner recovered from the intermediate transfer member, and the like, are unnecessary, and also, the residual toner on the intermediate transfer member can be cleaned by a charging device of a contact or noncontact type such as the aforementioned roller 8 alone. Therefore, the structure becomes remarkably simple, making it possible to provide a low cost cleaning means.

Also, the components employed by the intermediate transfer member cleaning means in accordance with the present invention are less likely to be mechanically damaged, that is, they are more durable, compared to the cleaning means employing a blade, a fur brush, or the like; the present invention can provide a reliable means for cleaning the intermediate transfer member.

In this embodiment, the external diameter of the electrode roller employed as the intermediate transfer member cleaning roller in this embodiment was 20 mm, but the careful studies conducted by the inventors of the present invention confirmed that any external diameter within a range of 12–30 mm suffices to provide a similar function. If the space is usable, the outer diameter may be larger.

Further, in this embodiment, a cylindrical photosensitive drum, and a cylindrical intermediate transfer member were employed, but obviously, a photosensitive member in the form of a belt, or an intermediate transfer member in the form of a belt can provide the same effects without any problem.

Further, in this embodiment, polymer toner manufactured using the suspension polymerization method was employed as the toner, but the toner manufactured using the ordinary pulverization method can also be used as long as the intermediate transfer member cleaning bias is optimized.

Further, in this embodiment, a belt transfer system was employed as the secondary transfer means, but employment of a corona type transfer system, or a transfer roller system, of the conventional type, does not affect the effects of the present invention.

Further, this embodiment was described with reference to the reversal development system, but the same effects can be expected even when the normal development system is employed, which will be concisely described below.

The primary transfer voltage of the intermediate transfer member has the same polarity as the photosensitive member, and the toner image is transferred onto the intermediate transfer member by applying, to the intermediate transfer member, a potential higher than the potential of the photosensitive member.

Similarly, the secondary transfer voltage of the transfer to the sheet has the negative polarity. Some residual toner after the secondary transfer has the negative polarity, and the other has the positive polarity. Similarly to the foregoing embodiment, the residual toner is charged to the polarity opposite from the regular polarity thereof. When the residual toner thus charged reaches the first transfer position, the potential of the intermediate transfer member is higher in the negative direction than the photosensitive member although their polarities are the same. Therefore, the residual toner on the intermediate transfer member is transferred back to the photosensitive drum simultaneously with the primary transfer.

When the conditions in terms of polarity, and other conditions are adjusted as described above, the same effects as those obtained in this embodiment can be obtained even when the normal development system is used. Incidentally, the specific structure of the apparatus is the same as that illustrated in FIG. 1, and the apparatus is operated with changes to the polarity of the voltage applied to various members.

Embodiment 2

In this second embodiment of the present invention, an electrically conductive fur brush is employed in place of the cleaning roller 8 employed in the first embodiment.

A fur brush is effective as the intermediate transfer member cleaning means because of the following reasons. Firstly, a conductive brush can charge the secondary transfer residual toner by injecting electric charge, and secondly, it scatters the secondary transfer residual toner on the intermediate transfer member while injecting the electric charge; in other words, the trace of the pattern formed by the residual toner from the preceding image formation can be erased by the fur brush. Consequently, the occurrence of the negative ghost described in the first embodiment can be more preferably suppressed, which is the merit of the fur brush.

Figure 11:
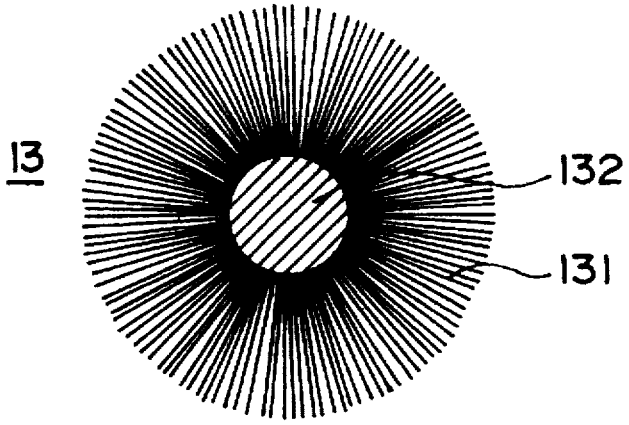
FIG. 11 is a schematic drawing of an intermediate transfer member cleaning means of a fur brush type employed in the second embodiment of the present invention.

FIG. 11 is a schematic section of a conductive fur brush 13. The conductive fur brush 13 comprises a metallic core 132 and bristles 131 planted on the peripheral surface of the metallic core 132. The material of the bristle 131 is nylon, and its resistance is controlled by dispersing micro-particles of carbon black in the nylon; the resistance value is approximately $10^2$–$10^3\Omega$ (when a voltage of 10 V is applied).

The size of the bristle 131 employed in this embodiment is 288 denier/48 filament, and its density is 100,000 filaments/inch$^2$.

The metallic core diameter is 10 mm, and the bristle length is approximately 4 mm. The overall diameter of the fur brush is approximately 20 mm.

As for other materials usable as the bristle material, a certain type of material, for example, rayon, polyester, or polypropylene, which allows a conductive agent to be directly dispersed therein, or the conductive agent to be sealed in the fiber made of such material, is preferable.

The resistance value of the fur brush is generally difficult to control. Careful studies conducted by the inventors of the present invention confirmed that as long as the fur brush is given approximately $10^{12}\Omega$ (when 1 kV is applied), the fur brush can provide a cleaning effect exceeding a predetermined level, as means for applying the cleaning bias to the intermediate transfer member.

As for the method for measuring the resistance, the fur brush is placed in contact with a piece of metallic plate of aluminum or the like, with the amount of brush invasion being set at 2 mm, and the current flowing through when a voltage of 1 kv is applied to the metallic core is monitored.

As for the size and density of the bristle, the larger the number of bristles per unit area, the better the cleaning performance; when the density of the bristle was no less than 50,000 filaments per square inch, preferable cleaning effects could be provided.

The conductive fur brush 13 with the above structure was assembled into the laser printer illustrated in FIG. 1 to confirm the intermediate transfer member cleaning effects of the fur brush 13.

Other structures, and the operational conditions were the same as those described in the first embodiment; therefore, their descriptions will be omitted.

The fur brush 13 is rotated by an unillustrated driving system similar to that for driving a conventional type fur brush. The rotational direction of the fur brush 13 in the location where the fur brush 13 brushes the intermediate transfer member 5 is the same as that of the intermediate transfer member 5. When the fur brush 13 is rotated in the direction opposite to the rotational direction of the intermediate transfer member 5, it scrapes away the toner on the intermediate transfer member 5, causing more toner to be scattered in the apparatus; therefore, the fur brush is preferred to be rotated in the same direction as the intermediate transfer member 5, with difference in the peripheral velocity. In this embodiment, the amount of the fur brush invasion into the intermediate transfer member 5 is approximately 2 mm.

According to the studies conducted by the inventors of the present invention, the fur brush 13 is effective when its peripheral velocity is within a range of 110–160% relative to that of the intermediate transfer member 5, and when it is no more than 110%, the occurrence of the cleaning failure or the negative ghost is liable to be affected by the magnitude of the cleaning bias. Further, when the ratio of the peripheral velocity to that of the intermediate transfer member 5 exceeds 160%, the toner is liable to be scattered in the apparatus by an excessive amount, increasing the internal contamination of the apparatus, as when the fur brush is rotated in the direction opposite to the rotational direction of the intermediate transfer member 5.

In this experiment, the peripheral velocity ratio of the fur brush relative to that of the intermediate transfer member 5 was set at 130%, and the fur brush was rotated in the same direction as the intermediate transfer member 5, wherein the magnitude of the bias applied to the fur brush was varied to observe the change in the intermediate transfer member 5 cleaning effect.

FIG. 12 shows the results of the above experiment.

As is evident from FIG. 12, the same results were obtained for the monochromatic mode and the four color superimposition mode. This is because after being charged for cleaning, the amount of the secondary transfer residual toner on the intermediate transfer member 5 is substantially the same whether in the monochromatic mode or in the four color superimposition mode, as shown in FIG. 8, but since the charge injection efficiency of the fur brush is relatively high, the difference in the triboelectrical charge of the secondary transfer residual toner becomes negligible.

Further, because of the toner scattering effects of the fur brush 13, the negative ghost image did not appear at all on the second print even when a high bias was applied.

According to the table in FIG. 12, the value of the applied voltage is 500 V. This is because of the following reason; when a voltage exceeding 500 V is applied, a large amount of current flows even into the intermediate transfer member 5, affecting the primary transfer bias, and thereby deteriorating image quality.

A printing test in continuous mode was conducted using the aforementioned laser printer, in which 100,000 prints were produced, and in which the fur brush 13 of this embodiment, that is, a contact type charging means, was employed as the intermediate transfer member cleaning means, with the secondary transfer bias value being set at 12 μA which was the same value as that in the preceding first embodiment. During the test, image formation failure related to the intermediate transfer member cleaning did not occur at all, proving that the intermediate transfer member could be reliably cleaned.

Further, compared to the elastic roller type cleaning means, the fur brush type cleaning means has merit in that the fur brush type cleaning means scatters the aforementioned residual toner on the intermediate transfer member while charging it, and therefore, the fur brush type cleaning means affords more latitude in the cleaning efficiency.

Embodiment 3

In this third embodiment of the present invention, a corona type charging device, which is a noncontact type charging means, is employed in plate of the cleaning roller 8 described in the first embodiment.

The corona type charging device as a charging means for cleaning the residual toner has merit in that, because the corona type charging device does not make contact with the intermediate transfer member, it does not need to be placed in contact with, or separated from, the intermediate transfer member, and therefore, its structure becomes remarkably simple, reducing the production cost. The corona type charging device also has other merits in that it is not liable to deteriorate through usage, and that the timing with which corona is discharged to the intermediate transfer member can be optionally set without being affected by other operational processes such as the primary transfer process.

Figure 13:
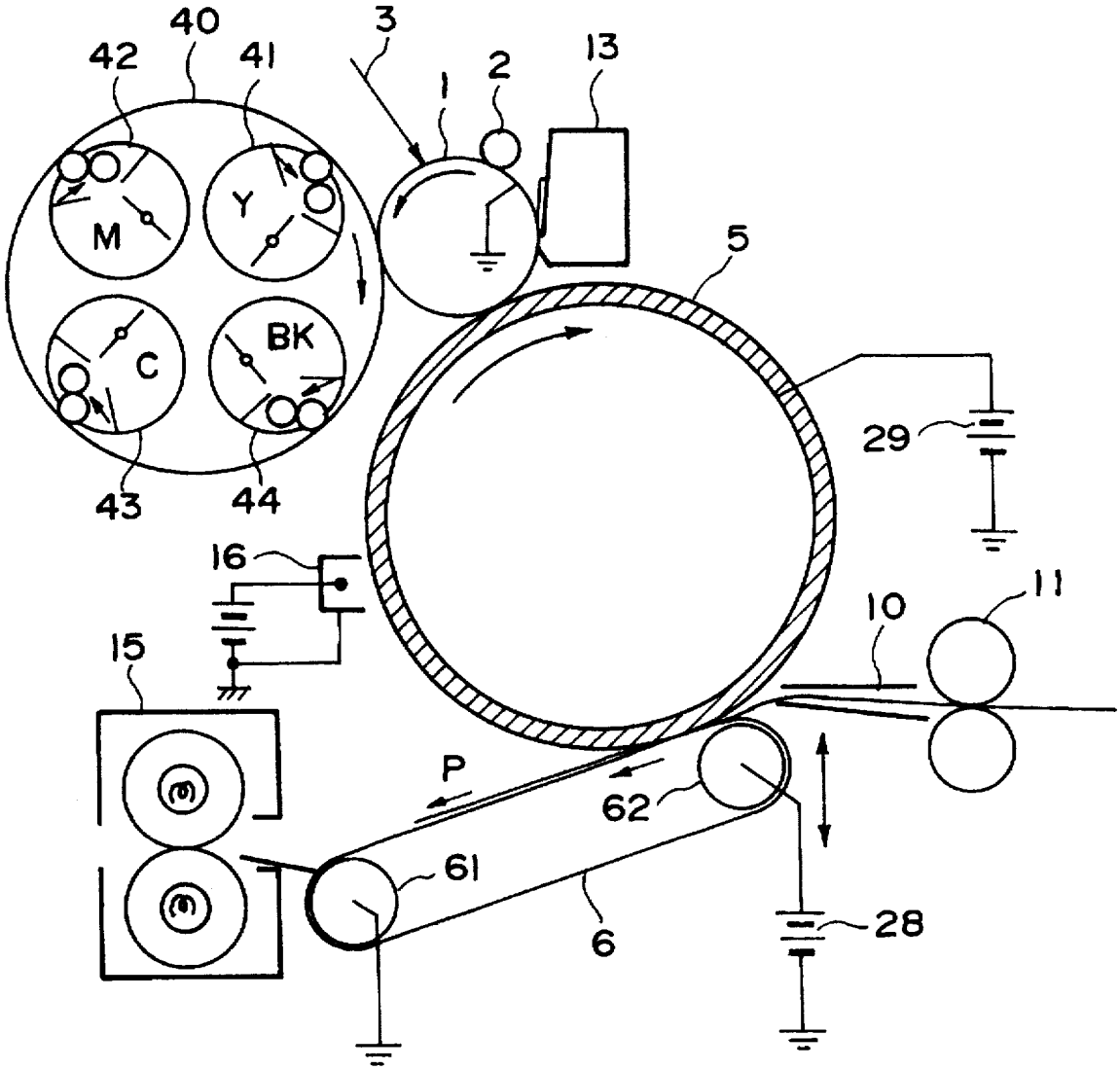
FIG. 13 is a schematic section of the laser printer in the third embodiment of the present invention.

FIG. 13 is a schematic section of the structure of a laser printer, into which a corona type charging device 16 as the intermediate transfer member cleaning means has been assembled. The structures and functions of essential components other than the intermediate transfer member cleaning means are the same as those of the laser printer, which was illustrated in FIG. 1, and was described in the first embodiment; therefore, their descriptions are omitted, and only the cleaning of the residual toner on the intermediate transfer member 5 by the corona type charging device 16 will be described in detail.

The time at which corona is discharged from the corona type charging device 16 to the intermediate transfer member 5 in order to clean the intermediate transfer member is after the beginning of the secondary toner image transfer from the intermediate transfer member 5 to the recording medium P, and before the leading end of the intermediate transfer member surface region, in which the toner image had been formed, reaches the location of the corona type charging device.

Figure 14:
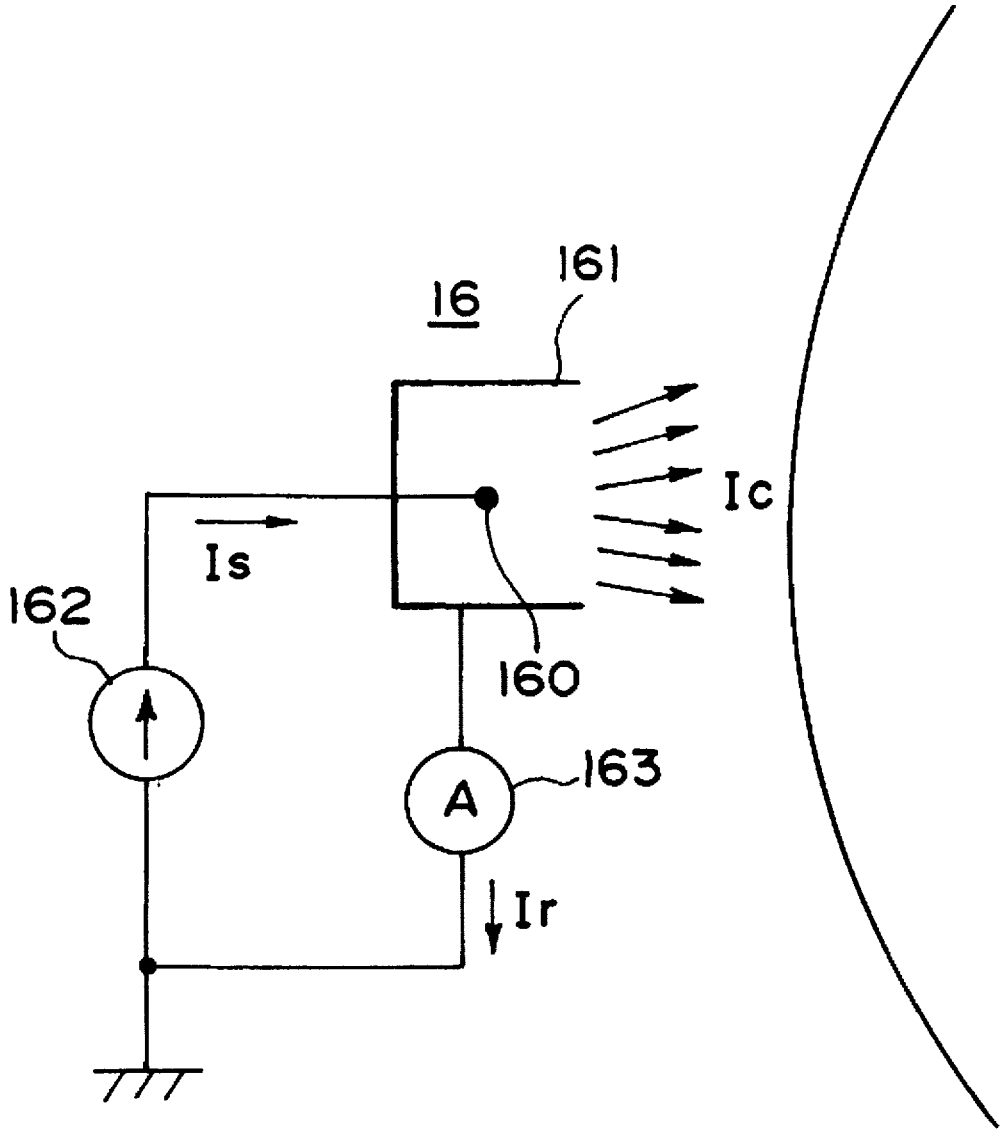
FIG. 14 is a schematic drawing depicting the intermediate transfer member cleaning means of the third embodiment of the present invention, in which a corona type charger is employed.

FIG. 14 is a schematic drawing defining the bias applied when the corona type charging device 16 is employed as the cleaning means. The value of a discharge current Ic caused to flow through the intermediate transfer member 5 by the corona type charging device 16 can be obtained by subtracting the value of a current Ir flowing through a shield plate 161 from the value of a current Is caused to flow through a corona wire 160 by a high voltage power source 162 under the constant current control; in other words, it can be obtained from the following formula:

$$Ic=Is-Ir$$

In this embodiment, the value of the discharge current Ic replaced the value of the cleaning bias, and the relationship between the discharge current Ic and the efficiency with which the intermediate transfer member was cleaned was studied.

The results are shown in FIG. 15. The secondary transfer bias was 12 μA also in this embodiment.

Since the corona type charging device 16 has a higher charging efficiency than the contact type charging means such as the elastic roller and the fur brush described in the preceding embodiments, the secondary transfer residual toner on the intermediate transfer member 5 can be sufficiently charged even when the discharge current is small. Therefore, as the discharge current excessively increases, the negative ghost is liable to appear.

The studies by the inventors of the present invention revealed that in the monochromatic mode, the intermediate transfer member 5 could be preferably cleaned when the discharge current was 5–20 μA, and in the four color superimposition mode, the intermediate transfer member 5 could be preferably cleaned when the discharge current was 10–20 μA.

The corona type charging device 16, that is, a noncontact type charging device described above, was installed as the cleaning means, in the aforementioned laser printer, and 100,000 prints were continuously outputted, with the secondary transfer bias being set at 12 μA which was the same as that in the first embodiment. As a result, image formation failure related to the cleaning of the intermediate transfer member did not occur at all, indicating reliable intermediate transfer member cleaning performance of the corona type charging device 16 in accordance with the present invention.

Further, the corona type charging device, a non contact type charging device, has merit in that it is superior to a contact type charging device in contamination resistance, durability, and the like, eliminating the need for replacing it during the service life of the apparatus main assembly.

As described above, in this embodiment, a charging means, which charges the toner remaining on the intermediate transfer member after the secondary transfer process to the polarity opposite to that of the toner image borne on the image bearing member is provided, and the residual toner charged by this charging means is transferred back from the intermediate transfer member to the image bearing member at the same time as the toner image on the image bearing member is transferred onto the intermediate transfer member through the primary transfer process. Therefore, the need for specifically allocating a certain length of time just to clean the intermediate transfer member is eliminated, increasing the number of prints which can be outputted within a predetermined period.

Embodiment 4

Another aspect of the present invention, which is applicable to the apparatus described in the first embodiment will be described.

In this embodiment, the apparatus structure, and the operational sequence in the full-color mode, are the same as those described in the first embodiment, in that two ore more toner images of a different color are transferred, in a superimposing manner, onto the intermediate transfer member 5 through two or more primary transfer processes, and these toner images are transferred all at once onto the recording medium.

However, this embodiment is different from the first embodiment in the continuous image formation sequence in the monochromatic color mode; the monochromatic color mode is a mode in which a monochromatic toner image is formed on the intermediate transfer member 5 through a single primary transfer process, and this toner image is transferred onto the recording medium; and the continuous image formation sequence is an image formation sequence for continuously forming an image on two or more recording mediums by inputting only a single print start signal from a computer or the like.

Figure 18:
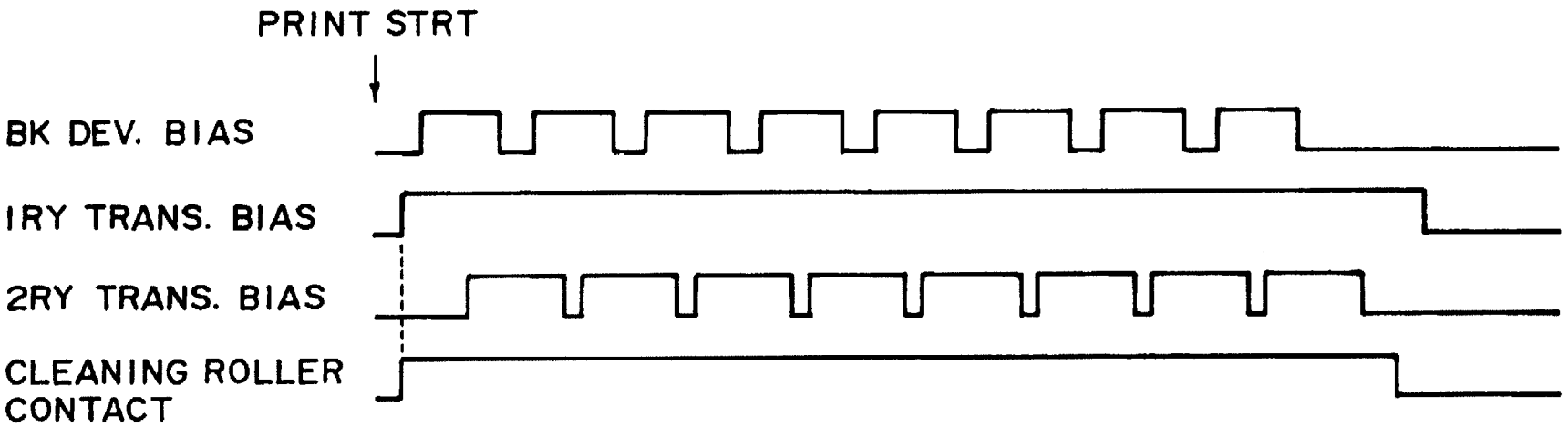
FIG. 18 is an operation sequence diagram for a monochromatic mode of the image forming apparatus in the second embodiment of the present invention.

This will be described with reference to FIG. 18.

In this embodiment, the application of the primary bias is started before the black toner image formed on the photosensitive drum 1 reaches the primary transfer point, and is continued at least until the trailing end of the residual toner image remaining on the intermediate transfer member 5 after the secondary transfer process for the last recording medium passes the primary transfer point. The sequence up to this point is the same as in the first embodiment.

However, in this embodiment, at the same time as the application of the primary transfer bias begins, the cleaning roller 8 is placed in contact with the intermediate transfer member 5 to apply the bias from the high voltage power source 27, and is left in contact with the intermediate transfer member 5, continuously applying the bias, at least until the trailing end of the residual toner image remaining on the intermediate transfer member 5 after the secondary transfer process for the last recording medium passes the contact point (charging point) between the intermediate transfer member 5 and the roller 8.

In other words, in this embodiment, while the primary transfer process is going on, the roller 8 is not moved to be placed in contact with the intermediate transfer member 5 or to be separated therefrom, nor is the bias turned on or off, preventing the primary transfer process from being subjected to the mechanical and electrical effects of the roller 8 movement. Therefore, the primary transfer process is more preferably carried out.

Incidentally, in this embodiment, the monochromatic mode was described with reference to the black toner, but the same description is applicable to toners of different colors.

Embodiment 5

Figure 19:
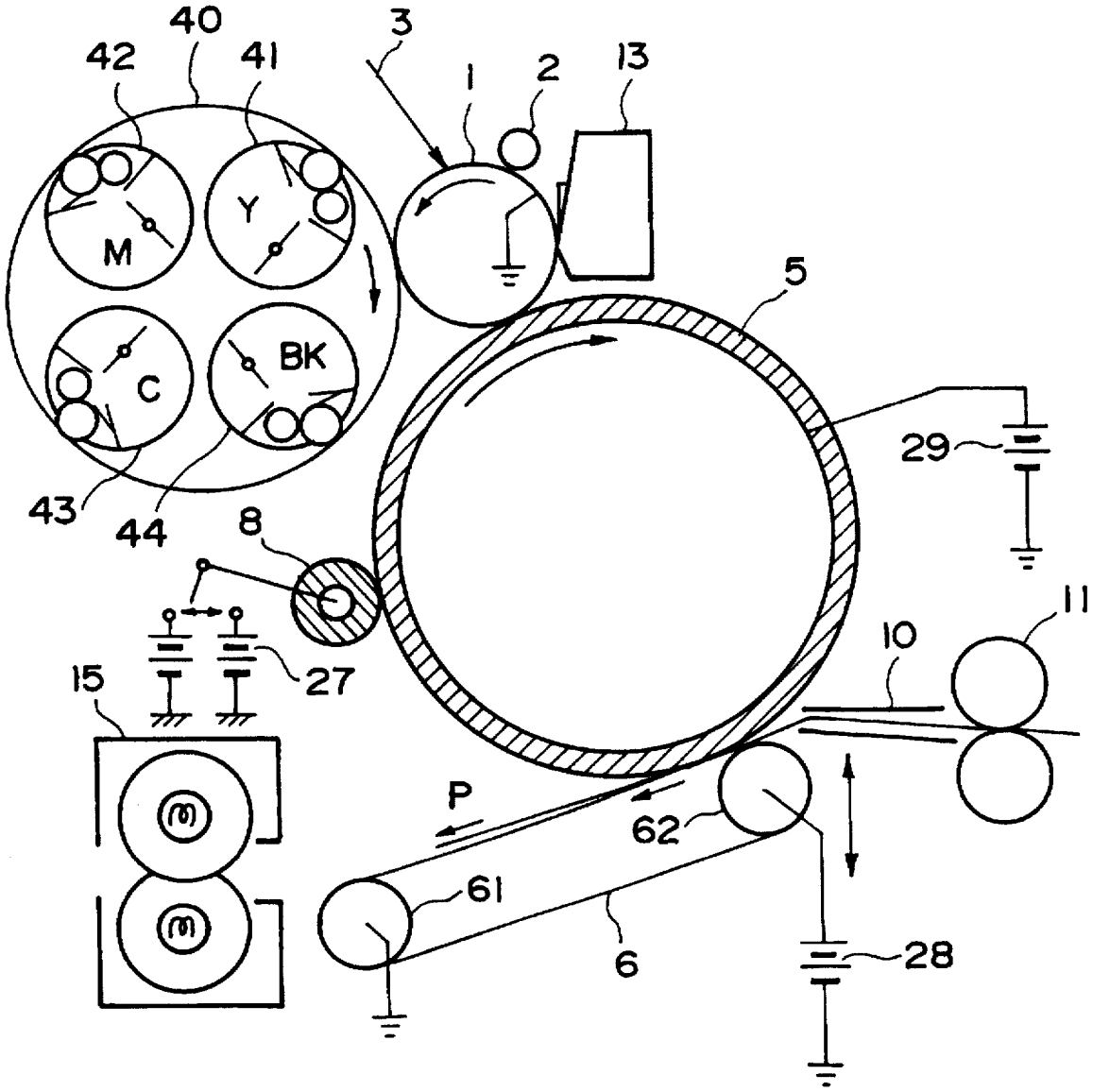
FIG. 19 is a schematic section of the laser printer in the third embodiment of the present invention.

FIG. 19 depicts an apparatus in accordance with another aspect of the present invention. This fifth embodiment is different from the first and fourth embodiments in that the cleaning roller 8 remains in contact with the intermediate transfer member 5 even during a continuous full-color image formation, and in that the high voltage power source 27 for outputting the bias to be applied to the cleaning roller 8 is capable of either a positive bias or a negative bias.

The positive bias outputted from the high voltage power source 27 is the same as those in the first and fourth embodiments, and the negative bias is such a bias that does not change the average triboelectrical charge Q/M of the toner on the intermediate transfer member 5. The magnitude of this negative voltage is −50 V—500 V.

Figure 20:
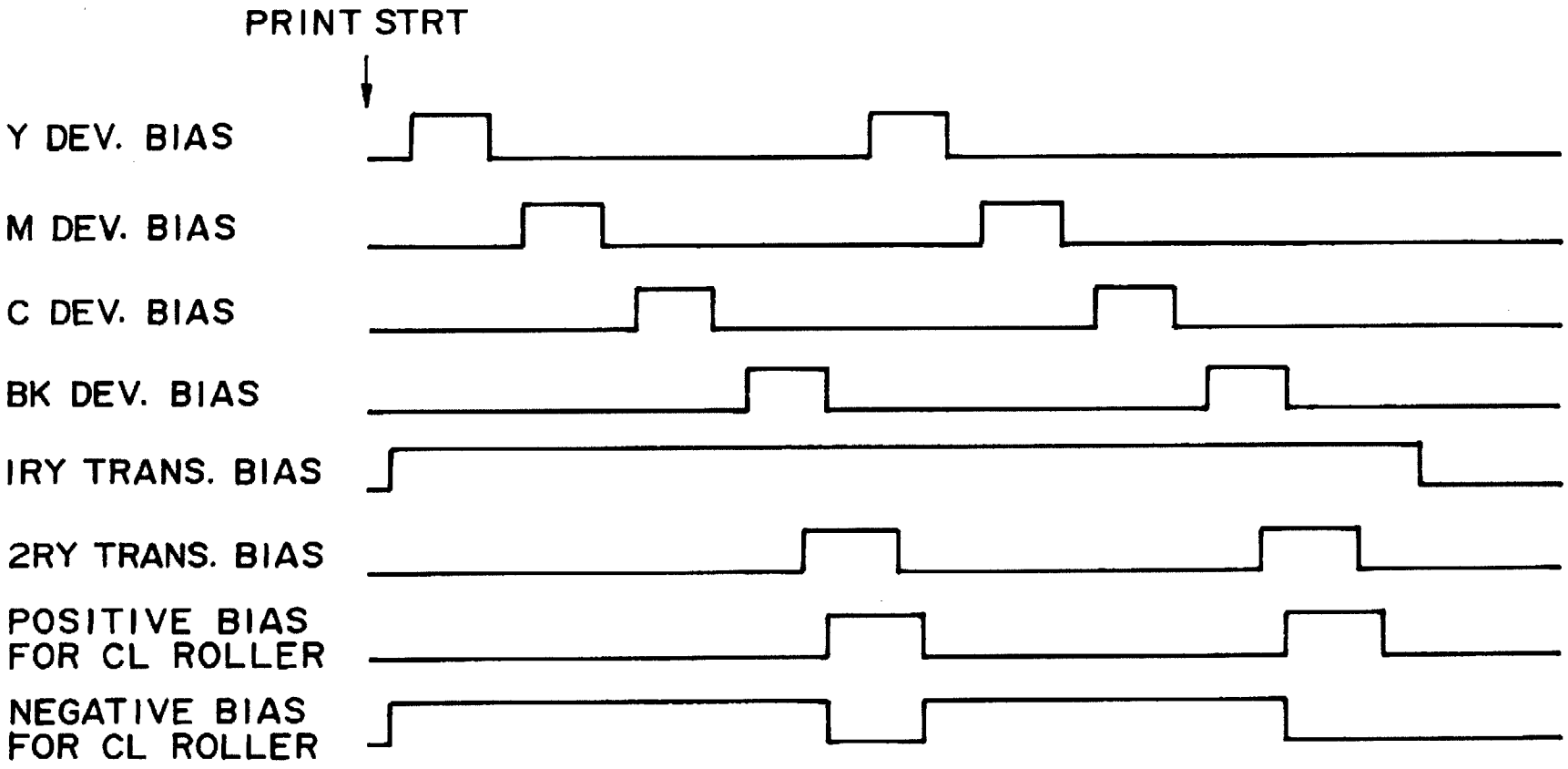
FIG. 20 is an operational sequence for a full color mode of the image forming apparatus in the third embodiment of the present invention.

FIG. 20 presents an operational timing for the continuous full-color mode image formation process carried out by the apparatus of this embodiment. The operational sequences such as the development sequence, the primary transfer sequence, the secondary transfer sequence, and the like, are carried out in the same manner as those in the first and fourth embodiments.

The cleaning roller 8 is fixed in contact with the intermediate transfer member 5. While the cleaning roller 8 is in contact with the four color superimposition image having been transferred on the intermediate transfer member 5, a negative voltage is applied with the timing designated as "negative bias for cleaning roller" in FIG. 20. Therefore, the polarity of the toner image having been transferred onto the intermediate transfer member 5 through the primary transfer process is not changed.

Next, in the middle of the secondary transfer process, the application of a positive bias to the roller 8 is started to charge the toner remaining on the intermediate transfer member 5 after the secondary transfer process, to the positive polarity, with the same timing as that with which the cleaning roller in the first embodiment was placed in contact with the intermediate transfer member 5 when in the full-color mode.

Then, after the completion of the secondary transfer for the first recording medium, as soon as the trailing end of the image form of the secondary transfer residual toner passes the nip (charging point) between the cleaning roller 8 and the intermediate transfer member 5, the positive bias designated as "positive bias for cleaning" is switched to the negative bias designated as "negative bias for cleaning" as shown in FIG. 20.

The printing sequence for the second page, that is, the last page, is the same as the printing sequence for the first page except that the residual toner on the intermediate transfer member 5 returns to the photosensitive drum through the primary transfer process, wherein even after the completion of the printing on the last page, the post-rotation is continued maintaining the primary transfer bias and the positive bias for cleaning the roller 8 as shown in FIG. 20. The timing for this post-rotation is the same as that in the first embodiment.

Figure 21:
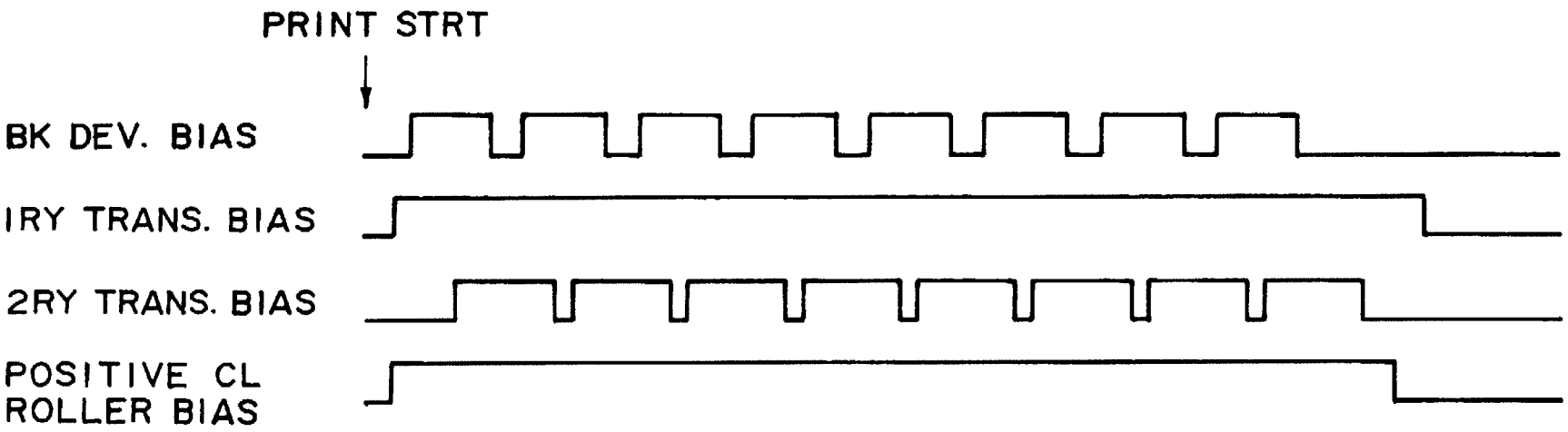
FIG. 21 is an operational sequence diagram for a monochromatic mode of the image forming apparatus in the third embodiment of the present invention.

Next, the operational sequence of the monochromatic (black) mode in this embodiment, which is depicted in FIG. 21, will be described. The description given below also applies to monochromatic modes in colors other than black.

Different from when in the full-color mode, a bias for charging the residual toner to the positive polarity is applied to the cleaning roller 8 using the timing designated as "positive bias for cleaning" in FIG. 21. In other words, the application of this bias is continued from the beginning of the primary transfer process until slightly after the trailing end of the residual toner image passes the nip between the cleaning roller 8 and the intermediate transfer member 5 after the printing of the eighth page, the last page. Other operational timings are the same as those in the first and fourth embodiments except that the cleaning roller is not placed in contact with, or separated from, the intermediate transfer member 5.

In the embodiments described above, the present invention was described with reference to a full-color printer employing a digital optical system, but the present invention is equally and effectively applicable to an image forming apparatus which uses a single toner, as well as an image forming apparatus which uses two or more color toners such as red toner, blue toner, yellow toner, or black toner. In other words, the present invention is also effectively applicable to an apparatus capable of reproducing only a single color, and can reduce the throughput time thereof as long as the apparatus is in the continuous image formation mode.

Further, as for the means for removing the secondary transfer residual toner having been transferred back to the image bearing member, the present invention is also compatible with known cleaning means such as the blade or brush of the conventional type.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus, wherein a toner image is transferred onto a transfer material using an intermediate transfer member, said image forming apparatus comprising:

an image bearing member;

toner image forming means for forming a toner image on said image bearing member;

an intermediate transfer member movable along an endless path in contact with said image bearing member;

bias voltage application means for applying a bias voltage for transferring the toner image from said image bearing member onto said intermediate transfer member at a first transfer position of said intermediate transfer member;

image transfer means for transferring the toner image from said intermediate transfer member onto the transfer material at a second transfer position of said intermediate transfer member;

residual toner charging means for charging residual toner remaining on said intermediate transfer member after image transfer therefrom, to a polarity opposite from a regular polarity of the toner to transfer back the residual toner, simultaneously with a next image transfer at the first transfer position, to said image bearing member when the residual toner passes through the first transfer position.

2. An apparatus according to claim 1, wherein said image bearing member is an electrophotographic photosensitive member, and is charged to a polarity which is the same as the polarity of the toner, and the toner image is formed through reverse development.

3. An apparatus according to claim 1, wherein said bias voltage application means applies the voltage of the polarity opposite from the toner.

4. An apparatus according to claim 3, wherein said intermediate transfer member has an electroconductive layer, to which said bias voltage application means applies the bias voltage for image transfer from said image bearing member to said intermediate transfer member.

5. An apparatus according to claim 1, wherein said image bearing member is an electrophotographic photosensitive member, and is charged go a polarity which is opposite from the polarity of the toner, and the toner image is formed through regular development.

6. An apparatus according to claim 5, wherein said bias voltage application means applies a voltage of a polarity opposite from that of the toner.

7. An apparatus according to claim 6, wherein said intermediate transfer member has an electroconductive layer, to which said bias voltage application means applies the bias voltage for image transfer from said image bearing member to said intermediate transfer member.

8. An apparatus according to claim 1, wherein said residual toner charging means includes electrode movable toward and away from said intermediate transfer member.

9. An apparatus according to claim 8, wherein said electrode is in the form of a rotatable roller.

10. An apparatus according to claim 8, wherein said electrode is in the form of a corona charger.

11. An image forming apparatus, wherein a toner image is transferred onto a transfer material using an intermediate transfer member, said image forming apparatus comprising:

an image bearing member;

toner image forming means for forming multi-color toner image on said image bearing member;

an intermediate transfer member movable along an endless path in contact with said image bearing member;

bias voltage application means for applying a bias voltage for transferring the toner image from said image bearing member onto said intermediate transfer member at a first transfer position of said intermediate transfer member, for each color;

image transfer means for transferring the color toner images all at once from said intermediate transfer member onto the transfer material at a second transfer position of said intermediate transfer member;

residual toner charging means for charging, after image transfer at the second transfer position, residual toner remaining on said intermediate transfer member after image transfer therefrom, to a polarity opposite from a regular polarity of the toner to transfer back the residual toner, simultaneously with a next image transfer at the first transfer position, to said image bearing member when the residual toner passes through the first transfer position.

12. An apparatus according to claim 11, wherein said image bearing member is an electrophotographic photosensitive member, and is charged to a polarity which is the same as the polarity of the toner, and the toner image is formed through reverse development.

13. An apparatus according to claim 11, wherein said bias voltage application means applies the voltage of the polarity opposite from the toner.

14. An apparatus according to claim 11, wherein said colors include yellow, magenta and cyan.

15. An apparatus according to claim 11, wherein said residual toner charging means includes an electrode movable toward and away from said intermediate transfer member.

16. An apparatus according to claim 15, wherein said residual toner charging means is out of contact with said intermediate transfer member until an end of a predetermined number of transfer operations from said image bearing member onto said intermediate transfer member.

17. An apparatus according to claim 16, herein said electrode is in the form of a rotatable roller.

18. An apparatus according to claim 11, wherein said electrode is in the form of a corona charger.

19. An apparatus according to claim 11, wherein said apparatus is operable in a single color mode and a multicolor mode.

20. An apparatus according to claim 19, wherein when a plurality of images are continuously formed in the single color mode, said residual toner charging means charges the residual toner on said intermediate transfer member for each transfer from said intermediate transfer member to the transfer material.

21. An image forming apparatus, wherein a toner image is transferred onto a transfer material using an intermediate transfer member, said image forming apparatus comprising:

an image bearing member which is an electrophotographic photosensitive member;

developing means for forming a toner image on said image bearing member, using black toner and chromatic toner;

an intermediate transfer member movable along an endless path in contact with said image bearing member;

bias voltage application means for applying a bias voltage for transferring the toner image from said image bearing member onto said intermediate transfer member at a first transfer position of said intermediate transfer member;

image transfer means for transferring the toner image from said intermediate transfer member onto the transfer material at a second transfer position of said intermediate transfer member;

wherein said apparatus is operable in a single color mode and in a multi-color mode;

residual toner charging means for charging, after image transfer at the second transfer position, residual toner remaining on said intermediate transfer member after image transfer therefrom, to a polarity opposite from a regular polarity of the toner to transfer back the residual toner, simultaneously with a next image transfer at the first transfer position, to said image bearing member when the residual toner passes through the first transfer position.

22. An apparatus according to claim 21, wherein said image bearing member is an electrophotographic photosensitive member, and is charged to a polarity which is the same as the polarity of the toner, and the toner image is formed through reverse development.

23. An apparatus according to claim 21, wherein said bias voltage application means applies the voltage of the polarity opposite from the toner.

24. An apparatus according to claim 21, wherein said colors include yellow, magenta and cyan.

25. An apparatus according to claim 21, wherein said residual toner charging means includes an electrode movable toward and away from said intermediate transfer member.

26. An apparatus according to claim 25, wherein said residual toner charging means is out of contact with said intermediate transfer member until an end of a predetermined number of transfer operations from said image bearing member onto said intermediate transfer member.

27. An apparatus according to claim 26, wherein said electrode is in the form of a rotatable roller.

28. An apparatus according to claim 21, wherein said electrode is in the form of a corona charger.

29. An apparatus according to claim 21, wherein when a plurality of images are continuously formed in the single color mode, said residual toner charging means charges the residual toner on said intermediate transfer member for each transfer from said intermediate transfer member to the transfer material.

* * * * *

UNITED STATES PATENT AND TRADEMARK OFFICE

CERTIFICATE OF CORRECTION

PATENT NO. : 5,732,310

DATED : March 24, 1998

INVENTOR(S) : Koichi Hiroshima, et al.

It is certified that error appears in the above-identified patent and that said Letters Patent is hereby corrected as shown below:

Column 1, line 45, delete "Nos," and insert therefor --Nos.-- and after "340,564/1992", insert --297,739/1993--.

Column 8, line 40, delete "baas" and insert therefor --bias--.

Column 9, line 66, delete "i" and insert therefor --1--.

Column 12, line 49, delete "$1\times10^4 1\times10^7$" and insert therefor --$1\times10^4$-$1\times10^7$".

Column 21, line 30, delete "plate" and insert therefor --place--.

UNITED STATES PATENT AND TRADEMARK OFFICE

CERTIFICATE OF CORRECTION

PATENT NO. : 5,732,310

DATED : March 24, 1998

INVENTOR(S) : Koichi Hiroshima, et al.

It is certified that error appears in the above-identified patent and that said Letters Patent is hereby corrected as shown below:

Column 22, line 66, delete "ore" and insert therefor --or--.

Column 25, line 23, after "member;", insert --and--;
Line 59, after "includes", insert --an--.

Column 26, line 2, after "forming", second occurrence insert --a--;
Line 13, after "member;", insert --and--;
Line 42, delete "herein" and insert therefor --wherein--.

Column 27, line 9, after "mode;", insert --and--.

Signed and Sealed this

First Day of September, 1998

*Attest:*

*Attesting Officer*

BRUCE LEHMAN

*Commissioner of Patents and Trademarks*